United States Patent [19]

Muramatsu et al.

[11] Patent Number: 4,738,034

[45] Date of Patent: Apr. 19, 1988

[54] DRYING MACHINE

[75] Inventors: Tsunehiro Muramatsu, Seto; Katsuharu Matsuo, Aichi; Tomio Hotta, Kuwana, all of Japan

[73] Assignee: Kabushiki Kaisha Toshiba, Kawasaki, Japan

[21] Appl. No.: 942,087

[22] Filed: Dec. 15, 1986

[30] Foreign Application Priority Data

Dec. 16, 1985 [JP] Japan ..... 60-193364[U]
Oct. 7, 1986 [JP] Japan ..... 61-238572
Oct. 7, 1986 [JP] Japan ..... 61-238573

[51] Int. Cl.[4] ..... F26B 21/00

[52] U.S. Cl. ..... 34/43; 34/48; 34/55

[58] Field of Search ..... 34/46, 48, 53, 55, 43

[56] References Cited

U.S. PATENT DOCUMENTS 4,412,384 11/1983 Kruger ..... 34/53
4,649,654 3/1987 Hikino et al. ..... 34/30

FOREIGN PATENT DOCUMENTS 6048198 4/1979 Japan .
55-153097 4/1979 Japan .
6027896 7/1983 Japan .

*Primary Examiner*—Larry I. Schwartz
*Attorney, Agent, or Firm*—Cushman, Darby and Cushman

[57] ABSTRACT

According to this invention, a drying machine includes detection electrodes arranged to face the interior of a drum constituting a drying chamber and to be capable of contacting clothes in the drum, a volume (weight)-of-clothes detecting circuit for detecting the volume of clothes based on a contact interval of the clothes to the detection electrodes upon rotation of the drum, an operation time display circuit for calculating an operation time based on the weight of clothes detected by the volume-of-clothes detecting circuit and causing a display to display it as an estimated time, a degree-of-dryness detecting circuit for detecting a degree of dryness based on the resistance of the clothes contacting the detection electrodes, a volume-of-dryness setting circuit, operable by a user, for selectively setting a plurality of target degrees of dryness, a remaining operation time determination circuit for determining a remaining operation time based on the degree of dryness detected by the degree-of-dryness detecting circuit and the target degree of dryness set by the degree-of-dryness setting circuit, a subtraction display circuit having a timepiece function for causing the display to display the remaining operation time determined by the remaining operation time determination circuit instead of the estimated time while sequentially decrementing it, and an operation control circuit for completing a drying operation after the remaining operation time determined by the remaining operation time determination circuit has elapsed.

18 Claims, 18 Drawing Sheets

| Tn / Vd | WEIGHT OF CLOTHES W | | |
|---|---|---|---|
| | LIGHT | MEDIUM | HEAVY |
| ≧4.0 V | 12' | 6' 40" | 2' 50" |
| ≧3.2 | 10' | 5' 25" | 2' 20" |
| ≧1.9 | 8' | 3' 50" | 1' 40" |
| ≧1.25 | 6' | 1' 38" | 42" |
| ≦1.25 | 5' | 10" | 10" |

DRYING MACHINE

BACKGROUND OF THE INVENTION

The present invention relates to a drying machine which can estimate a time required for a drying operation.

In a typical drying machine, a user operates a timer to set a drying operation time, and after the drying operation time has elapsed, the drying operation is ended. In contrast to this, in some recent drying machines, the machine can detect that clothes in a drying chamber have attained a predetermined degree of dryness and the machine then automatically completes the drying operation. However, in this drying machine, since the user cannot determine when the drying operation is completed, clothes are often left in the drying chamber, in which waste heat still remains, and the clothes therein become wrinkled.

A technique for eliminating this drawback is described in Japanese Patent Publication No. 60-48198 entitled "DRYING MACHINE", the inventor: Miwa, the filing date: Apr. 28, 1979. This patent discloses a drying machine which includes a remaining time estimating device for detecting the rate of increase in exhaust temperature and for estimating a remaining time of a drying operation based on the detection result and prestored estimated remaining time data, a remaining time determination device for detecting the degree of dryness of clothes to be dried to determine the remaining time of the drying operation, and a display device for displaying the respective time data and a stop period time display which is formed between the respective time displays. Japanese Utility Model Disclosure No. 55-153097 entitled "DRYING MACHINE", the inventor: Yamauchi, the filing date: Apr. 23, 1979, on the other hand, discloses a drying machine which includes a temperature detector for detecting the rate of increase in exhaust temperature from the drying machine at the beginning of the drying operation, a remaining time estimating device for estimating a remaining time of the drying operation in accordance with the rate of increase in exhaust temperature, and a display device for displaying the estimated time. Also, Japanese Utility Model Disclosure No. 60-27896 entitled "VOLUME OF CLOTHES DETECTING DEVICE FOR DRYING MACHINE", the inventor: Hotta, the filing date: July 29, 1983, discloses a volume-of-clothes detecting device which comprises a pulse generator, having an electrode, which contacts clothes to be dried in a rotary chamber, for generating a pulse upon contacting of the clothes, and a discriminating device for discriminating a pulse generation frequency of the pulse generator.

More specifically, a temperature sensor for detecting an exhaust temperature from the drying chamber is provided to detect an exhaust temperature from the drying chamber at the beginning of the drying operation, thereby measuring the rate of increase in exhaust temperature. A time required for the drying operation is estimated in accordance with the rate of increase in exhaust temperature, and the estimated time data is displayed on the display device. The time required for the drying operation is estimated in accordance with the inventor's experiences such that if the exhaust temperature increases slowly at the beginning of the drying operation, the period is prolonged.

With this arrangement, the user can determine an approximate time required for the drying operation at the beginning of the drying operation by referring to the display device. Therefore, if the user leaves the area and later returns to the drying machine when the drying operation should be ended, he or she can pick up dried clothes from the drying chamber, resulting in convenience to the user.

However, the aforementioned arrangement still has the following drawbacks.

Since the heat capacity of wet clothes is considerably large, it takes a long period of time until the exhaust temperature increases. Therefore, in order to obtain a practical measurement precision, 10 to 20 minutes are required. For this reason, the user cannot confirm an estimated time until 10 to 20 minutes has elapsed from the beginning of the drying operation, and must wait until the estimated time data is displayed. Therefore, an estimation function cannot be effectively used.

For example, if washing is performed with hot water, since clothes put into the drying chamber are warm from the beginning, the exhaust temperature is increased too early, and an estimated time is considerably different from a time required for an actual drying operation. With this estimation method, an estimated value is influenced by ambient temperature, humidity, a power supply voltage, and the like, and estimation precision cannot be sufficiently improved.

SUMMARY OF THE INVENTION

It is an object of the present invention to provide a drying machine which can estimate a time required for a drying operation as accurately and quickly as possible and can display or signal it to a user.

In order to achieve the above object of the present invention, there is provided a drying machine comprising:

a detection electrode provided in a drum constituting a drying chamber and which is capable of contacting clothes in the drum;

volume-of-clothes detection means for detecting a volume of clothes based on a degree of contact of the clothes to the detection electrodes upon rotation of the drum;

means for calculating an estimated time required for a drying operation based on the volume of clothes detected by the volume-of-clothes detection means and estimated time display means for displaying the estimated time calculated by the means for calculating the estimated time.

According to the present invention, since a time required for a drying operation is not estimated in accordance with a change in temperature upon execution of the drying operation but with contacting of clothes to detection electrodes, the drying machine can quickly determine an accurate estimated drying time, which includes almost no errors due to variations in ambient conditions.

BRIEF DESCRIPTION OF THE DRAWINGS

Other objects and features of the present invention will be apparent from the following description taken in connection with the accompanying drawings, in which:

FIGS. 1 through 3 show a first embodiment of the present invention, in which:

FIG. 1 is a block diagram showing an electrical arrangement,

FIG. 2 is a front view of a display device, and

FIG. 3 is a longitudinal sectional view of an entire drying machine;

FIGS. 4 through 11 show a second embodiment of the present invention, in which:

FIG. 4 is a block diagram showing an electrical arrangement;

FIG. 5 is a circuit diagram of an entire machine,

FIG. 6 is a flow chart showing an entire drying operation,

FIG. 7 is a flow chart showing an estimated time determination routine,

FIG. 8 is a waveform chart showing a resistance detecting signal,

FIG. 9 is a graph showing the relationship between a volume of clothes and a contact interval, FIG. 10 is a graph showing the relationship between a degree of dryness of clothes and a resistance, and FIG. 11 is a graph showing the relationship between a contact interval, a degree of dryness, and a time required for a drying operation;

DETAILED DESCRIPTION OF THE PREFERRED EMBODIMENTS

Figure 1:
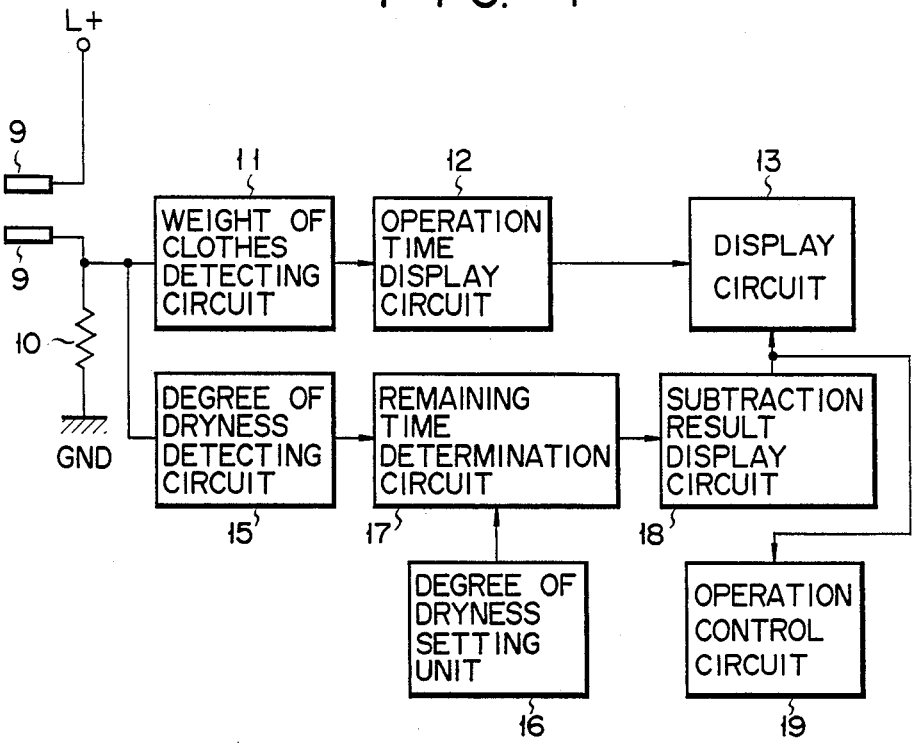

An embodiment of the present invention will now be described with reference to FIGS. 1 through 3. Referring to FIG. 3, a drying machine of the present invention has outer housing 1 and drum 2 constituting a drying chamber. Large-diameter openings 2*a* and 2*b* are formed in the front and rear end faces of drum 2. Opening 2*a* on the front end face side is engaged with the outer peripheral portion of annular support plate 3 fixed inside of outer housing 1 on the front end face side. Opening 2*b* on the rear end face side is engaged with the outer peripheral surface of flat casing 4 fixed inside of housing 1 on the rear end face side. Flat casing 4 has an open rear end face, and comprises double-fin fan 5 therein. Drum 2 and fan 5 are driven by a motor (not shown). Upon rotation of fan 5, air flow inside drum 2 is drawn by suction from inlet port 4*a* formed at the center of the front surface of casing 4 into casing 4 via lint filter 6, is heated by heater 7, and is again returned to drum 2. At the same time, air flow outside housing 1 is drawn by suction from outer air inlet port 1*a* formed in the rear surface portion of housing 1, is subjected to heat exchange with air flowing in front of fan 5 inside drum 2, and is then exhausted from outer air outlet port 1*b* formed in the rear surface of housing 1.

In addition, support 8 is fixed to the lower portion of annular support plate 3. A pair of detection electrodes 9 are fixed to support 8. Detection electrodes 9 face the inside of drum 2 to be in contact with clothes put into drum 2. As shown in FIG. 1, one detection electrode 9 is connected to DC power supply line L+ to which a constant DC voltage is applied, and the other detection electrode 9 is connected to ground line GND through resistor 10. Weight (volume)-of-clothes detecting circuit 11 shown in FIG. 1 counts pulse signals generated when the volume of clothes is detected based on, e.g., a degree of contact of clothes to detection electrodes upon rotation of drum 2, thereby detecting the volume of clothes. Operation time display circuit 12 calculates a typical time required for drying that volume of clothes, i.e., a time required for a drying operation, in response to a signal from detecting circuit 11 and in accordance with prestored data, and causes display circuit 13 to display it as an estimated time.

Figure 2:
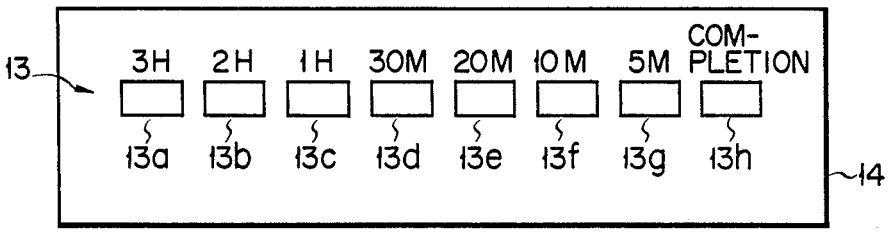
Figure 3:
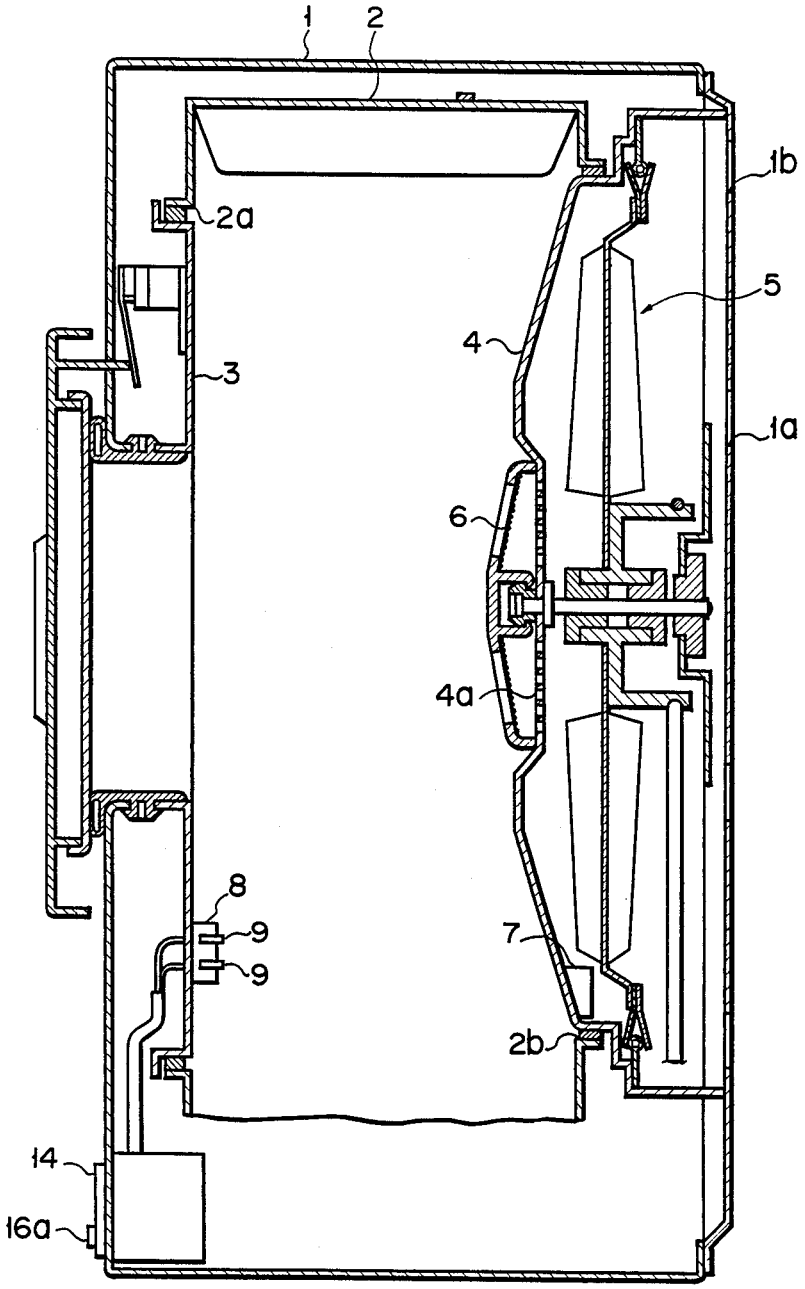

In display circuit 13, for example, eight lightemitting diodes 13*a* through 13*h* are horizontally aligned on operation panel 14 arranged on the lower portion of the front surface of outer housing 1, as shown in FIG. 2. Letters "3H", "2H", "1H", "30 MIN", "20 MIN", "10 MIN", "5 MIN", and "COMPLETION" are respectively printed on the portions of operation panel 14 above light-emitting diodes 13*a* through 13*h* from the left one. If a time required for drying operation is 3 hours, only light-emitting diode 13*a* with indication "3H" is turned on. If the time is 2 hours and 15 minutes, light-emitting diodes 13*b*, 13*f*, and 13*g* with respective indications "2H", "10 MIN", and "5 MIN" are turned on at the same time.

Referring back to FIG.1, reference numeral 15 denotes a degree-of-dryness detecting circuit, which utilizes the difficult resistances of clothes contacting between detection electrodes 9 in accordance with their degree of dryness, and detects the degree of dryness of clothes in accordance with the resistance to output a detecting signal when a predetermined degree of dryness, e.g., 95%, is reached. Note that when the degree of dryness of clothes reaches 95%, the resistance of clothes contacting between detection electrodes 9 is abruptly increased.

Reference numeral 16 denotes a degree-of-dryness setting circuit, with which a user can set a final degree of dryness, i.e., a target degree of dryness. When the user selectively depresses three operation buttons 16*a* (only one is shown in FIG. 3), one of a plurality of preset target degrees of dryness can be selectively set. The preset degrees of dryness include a "thorough" degree of dryness suitable for thick clothes and an "iron press" degree of dryness in a semidried state suitable for iron press after the completion of drying operation in addition to a "standard" degree of dryness as a typical degree of dryness.

Reference numeral 17 denotes a remaining time determination circuit, which determines a time required for drying operation, i.e., a remaining operation time upon reception of a detecting signal from detecting circuit 15 in accordance with the detected degree of dryness and a target degree of dryness set by the user. In this embodiment, when the target degree of dryness is set to the "thorough" degree of dryness, the remaining time is determined to be 30 minutes. When the target degree of dryness is set to the "standard" degree of dryness, the remaining time is determined to be 20 minutes, and when it is set to the "iron press" degree of dryness, it is determined to be 5 minutes. Reference numeral 18 denotes a subtraction result display circuit, which has a timepiece function, and sequentially subtracts the time determined by determination circuit 17 upon lapse of time to cause display circuit 14 to display it together with the first displayed estimated time.

Reference numeral 19 denotes an operation control circuit, which controls energization of the motor and heater 7. Upon reception of a stop signal output from display circuit 18, control circuit 19 deenergizes heater 7 to perform a so-called cool down operation, and then stops the motor to complete the drying operation.

The operation of this embodiment will be described. Assume that clothes are put into drum 2, and operation button 16*a* is depressed to set a desired degree of dryness, i.e., the "iron press" degree of dryness. When a start switch (not shown) is turned on, the drying operation is started. Upon rotation of drum 2, the clothes therein are rotated to be in contact with detection electrodes 9. Therefore, in accordance with the degree of contact, the volume of clothes is discriminated by detecting circuit 11, and an estimated time is calculated by display circuit 12 in accordance with the volume of clothes. Then, the estimated time is displayed on display circuit 13. Thus, the user can estimate an end time of the drying operation and can do another operation until then, resulting in convenience. In this case, in a conventional method wherein an estimated time is calculated in accordance with a change in exhaust temperature, the user must wait for a certain period of time until the calculated time is displayed. However, in this embodiment, the estimated time can be displayed immediately after the drying operation starts.

When the drying operation of clothes progresse and the degree of dryness has reached 95%, a detecting signal is generated from detecting circuit 15. Thus, a remaining time is determined by determination circuit 17 to be 5 minutes, and light-emitting diode 13*g* is turned on to indicate that the drying operation will be completed in 5 minutes. The remaining time "5 minutes" thus displayed is accurate since it is determined based on the fact that the degree of dryness of clothes has reached a predetermined value. The user can accurately determine that the drying operation is completed in 5 minutes. After 5 minutes have passed, the drying operation is completed at the degree of dryness suitable for iron press. Therefore, the user can pick up the clothes from drum 2 and iron them.

In this embodiment, since an estimated time is displayed immediately after the drying operation is started, the user can estimate the end time of the drying operation at an early time, thus providing great practical advantages. The user need only put clothes into drum 2 and select the desired degree of dryness without setting the volume of clothes. Thus, since the drying operation can be completed without setting the volume of clothes and a desired degree of dryness can be obtained by setting a target degree of dryness, the drying machine of this embodiment is very advantageous when iron press is performed after the drying operation or when the drying operation is to be performed in accordance with types of clothes, resulting in convenience.

In the above embodiment, determination circuit 17 determines a remaining operation time based on only a target degree of dryness set by setting circuit 16. However, the present invention is not limited to this. The remaining operation time can be determined by determination circuit 17 based on both the volume of clothes detected by detecting circuit 11 and the target degree of dryness since an appropriate remaining operation time after a predetermined degree of dryness is reached tends to be influenced by the volume of clothes. In addition, for example, the display circuit can adopt a 7-segment type numerical display. Thus, various changes and modifications may be made within the spirit and scope of the invention.

A second embodiment of the present invention will now be described with reference to FIGS. 4 through 11. Since the drying machine of this embodiment has the same arrangement as that in the first embodiment, a detailed description thereof is omitted, and an electrical arrangement will be mainly described hereinafter.

In the first embodiment, a volume-of-clothes detecting circuit detects the volume of clothes based on the number of contact times of clothes to the detection electrodes. In the second embodiment, the volume of clothes is detected based on a contact interval of clothes to detection electrodes.

In the first embodiment, a remaining operation time is determined based on the detected degree of dryness and a target degree of dryness set by a user. In the second embodiment, a time required for the drying operation is determined based on both a contact interval of clothes to detection electrodes and the resistance of clothes.

Figure 4:
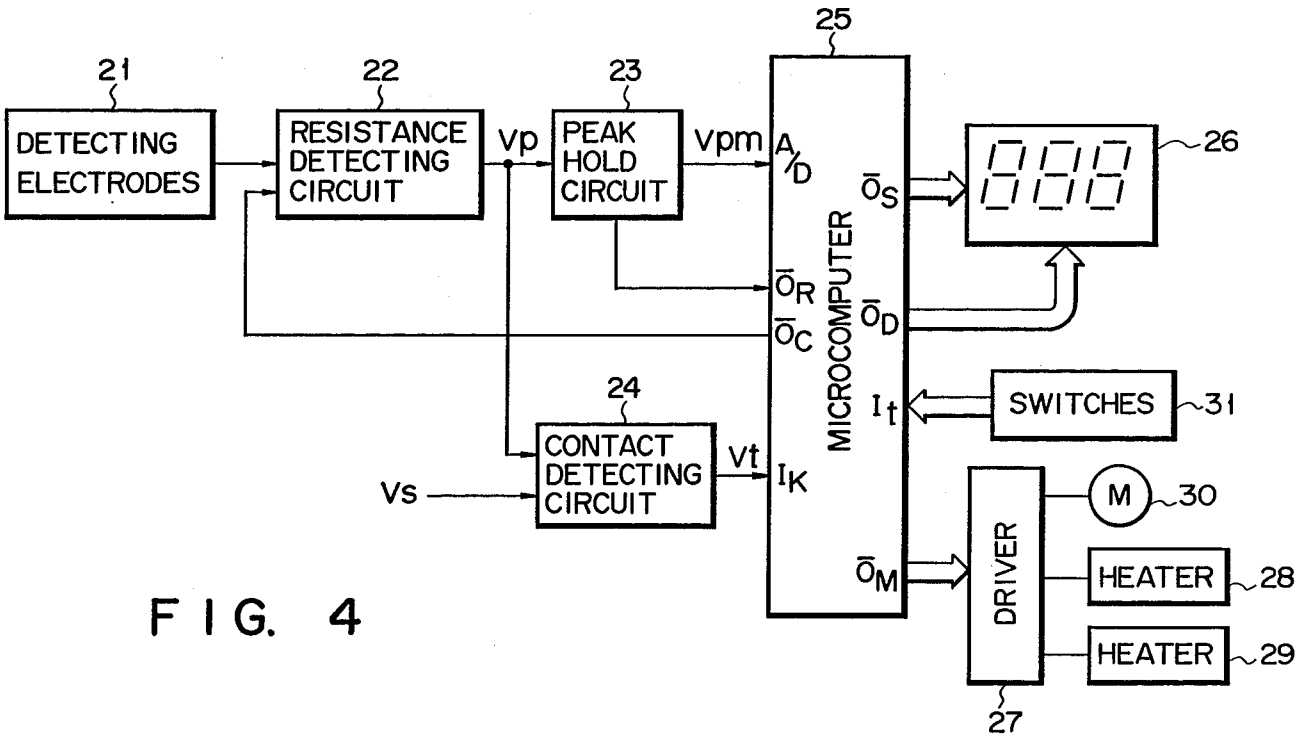

In FIG. 4, which schematically shows the entire electrical arrangement, reference numeral 21 denotes a pair of detection electrodes disposed to face a drum as in the first embodiment; 22, a resistance detecting circuit for detecting a resistance between detection electrodes 21 to output resistance detecting signal Vp corresponding thereto; 23, a peak hold circuit for storing maximum value Vpm of resistance detecting signal Vp within a predetermined time interval; and 24, a contact detecting circuit. Detecting circuit 24 generates High-level contact detecting signal Vt when resistance detecting signal Vp exceeds predetermined voltage level Vs, as will be described in detail below. Reference numeral 25 denotes a microcomputer, which calculates a time required for a drying operation and causes time display unit 26 to display it thereon. In addition, microcomputer (control circuit) 25 controls heaters 28 and 29, motor 30, and the like through driver 27 to execute a predetermined drying operation. Note that reference numeral 31 denotes switches including an operation course setting switch, a start switch, and the like.

Figure 5:
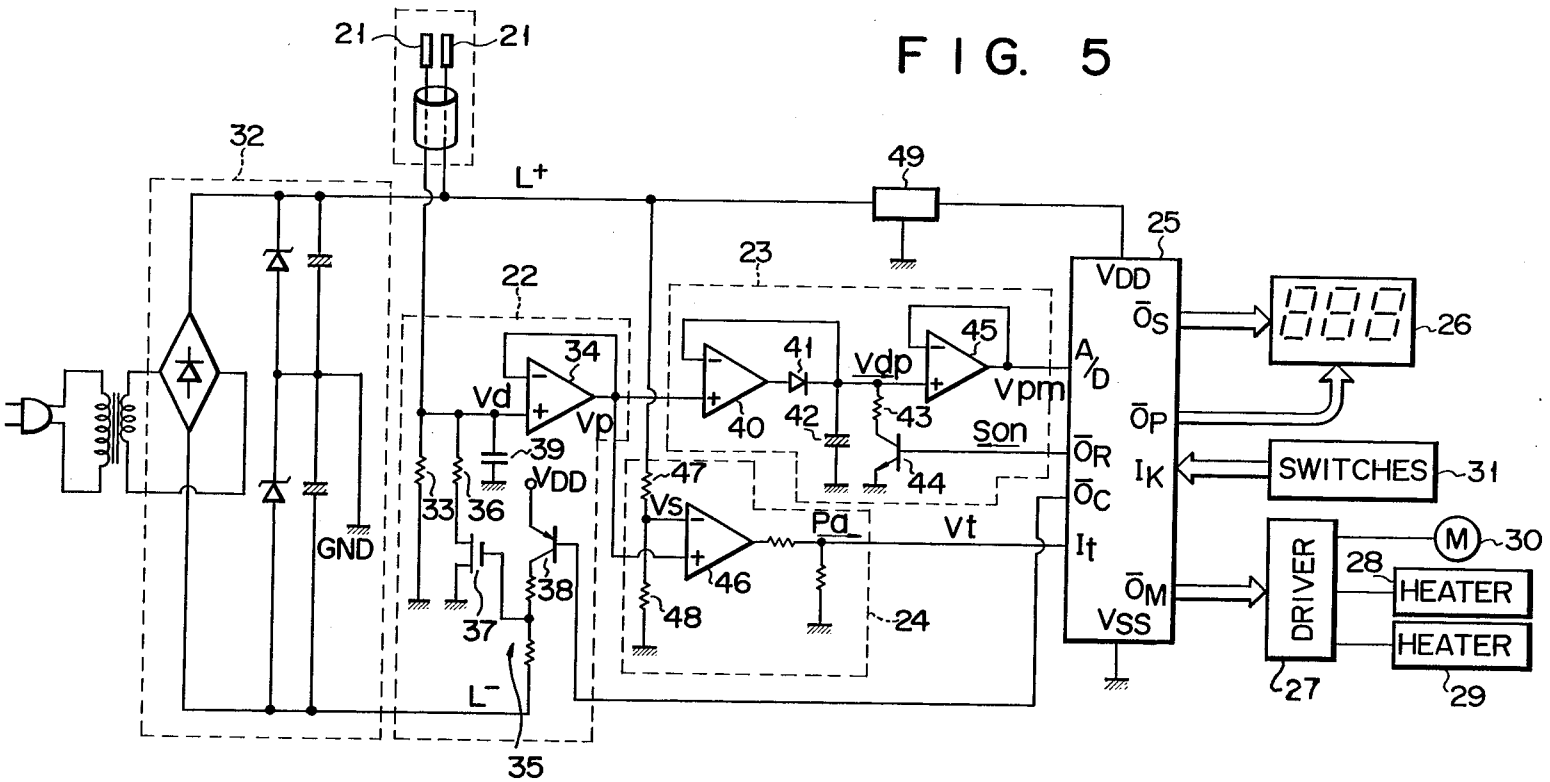

FIG. 5 shows the electrical arrangement of this embodiment in detail. In FIG. 5, reference numeral 32 denotes a rectifier circuit, which outputs positive and negative constant DC voltages (e.g., +15 V and −5 V) between lines L+ and L− and ground line GND. In resistance detecting circuit 22, one detection electrode 21 is connected to line L+, the other detection electrode 21 is connected to ground line GND through resistor 33, and a common node between resistor 33 and detection electrode 21 is connected to a non-inverting input terminal (+) of voltage-follower type operational amplifier 34. When wet clothes contact between detection electrodes 21, a voltage at line L+ is divided by its equivalent resistance and resistor 33, and the divided voltage is input to the non-inverting input terminal (+). Therefore, resistance detecting signal Vp, i.e., a voltage corresponding to the resistance of clothes contacting detection electrodes 21 is output from the output terminal of operational amplifier 34. Reference numeral 35 denotes a voltage division ratio converter, in which a series circuit of resistor 36 and FET 37 is connected in parallel with resistor 33, and the gate potential of FET 37 is controlled by transistor 38. When FET 37 is turned off, since resistor 36 is removed from the circuit, the resistance between the non-inverting input terminal (+) of operational amplifier 34 and ground line GND (to be referred to as a detection resistance hereinafter) is equal to the resistance of resistor 33. Conversely, when FET 37 is turned on to insert resistor 36 in the circuit, the detection resistance is substantially equal to a parallel sum resistance of resistors 33 and 36. The resistance of resistor 33 is set to be several MΩ which is substantially equal to the equivalent resistance of clothes whose degree of dryness is about 90 to 95%. The resistance of resistor 36 is set so that a sum resistance when it is connected in parallel with resistor 33 becomes about 20 kΩ which is lower than the resistance of clothes corresponding to the degree of dryness of 55 to 75%. Reference numeral 39 denotes a capacitor which removes external static noise from the clothes detection signal.

In peak hold circuit 23, the output terminal of voltage-follower type operational amplifier 40 for receiving resistance detecting signal Vp is connected to capacitor 42 through diode 41, and a discharge circuit, as a series circuit of resistor 43 and transistor 44, is connected in parallel with capacitor 42. The terminal voltage of capacitor 42 is input to A/D conversion terminal A/D of microcomputer 25 through voltage-follower type operational amplifier 45. Transistor 44 is turned on, e.g., every 10 sec to discharge capacitor 42 and, hence, maximum value Vpm of resistance detecting signal Vp for every 10 sec is input to terminal A/D of microcomputer 25.

In contact detecting circuit 24, the non-inverting input terminal (+) of operational amplifier 46 is connected to the output terminal of operational amplifier 34 in resistance detecting circuit 22, and the inverting input terminal thereof (−) is connected to a common node between series-connected resistors 47 and 48 between line L+ and ground line GND so as to serve as a comparator. Therefore, when resistance detecting signal Vp from detecting circuit 22 exceeds reference voltage Vs determined by the voltage division ratio of resistors 47 and 48, High-level contact detecting signal Vt is input to input terminal It of microcomputer 25. Note that reference numeral 49 denotes a constant voltage IC for stabilizing a voltage supplied to microcomputer 25.

The operation of this embodiment will now be described. A functional arrangement of microcomputer 25 will be apparent from the following description. Note that 4-bit microcomputer TMP-47C441AN available from TOSHIBA is best suited for the microcomputer of this embodiment.

Figure 6:
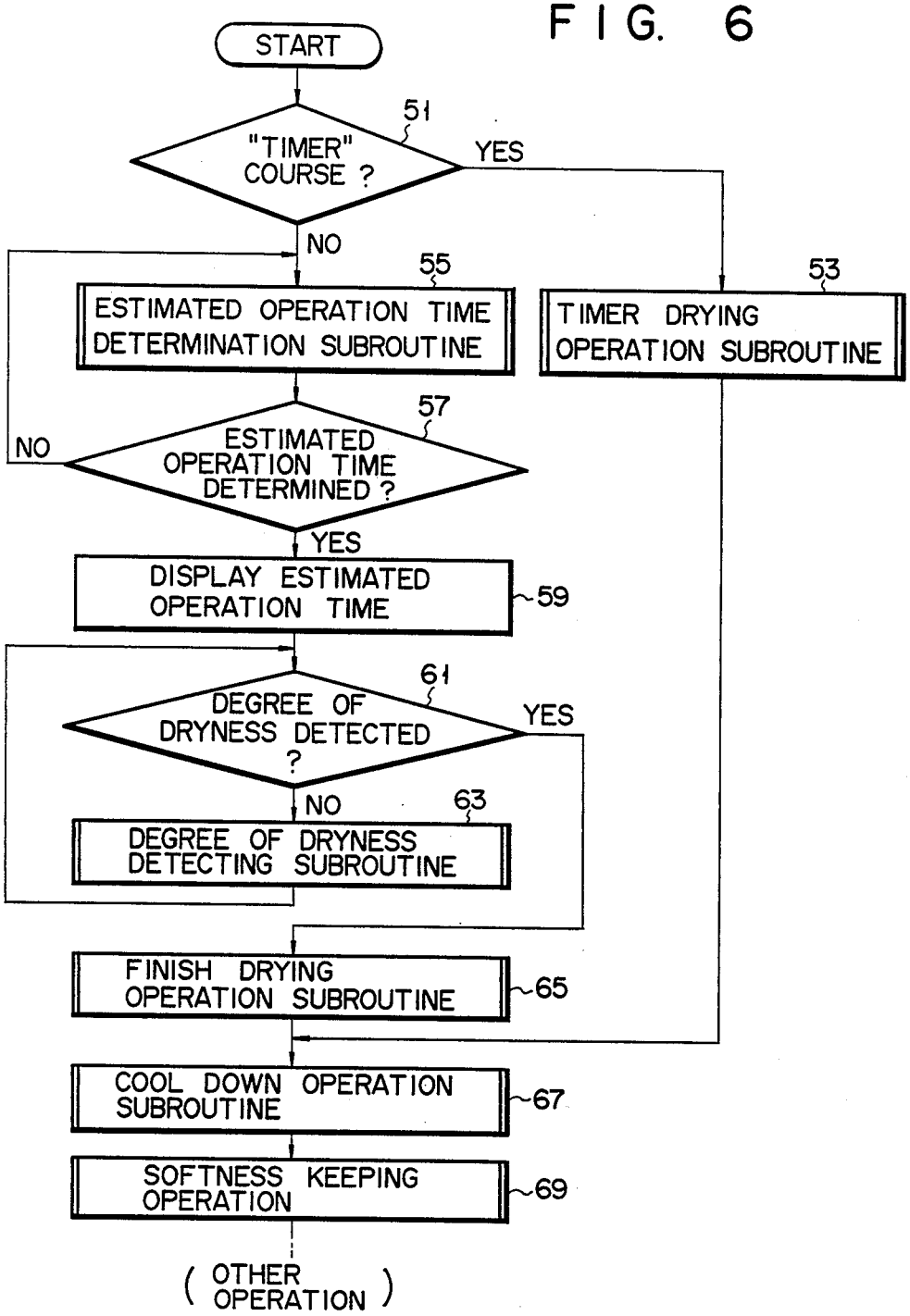

When the start switch of switches 31 is operated, a drying operation is executed as shown in the flow chart of FIG. 6. Prior to the start of the operation, if it is determined in step 51 that a "timer course" is selected by a course selection switch, YES is obtained in step 51, and a "timer drying operation" is executed for a time obtained by subtracting a time required for a "cool down operation" from a preset time set in a timer, such that the drum is rotated while heaters 28 and 29 and motor 30 are energized to supply warm air flow into the drum (step 53). Thereafter, the "cool down operation" (step 67) and a "softness keeping operation" (step 65) are performed in this order. In the "cool down operation", motor 30 is energized while heaters 28 and 29 are deenergized, so that cold air flow is supplied into the drum upon rotation thereof, thereby gradually cooling clothes after the drying operation. In the "softness keeping operation", when the clothes are not picked up from the drum after a predetermined period of time has passed after the drying operation, the drum is rotated for each predetermined period of time, so as to prevent clothes from being wrinkled. Note that if the clothes are picked up from the drum immediately after the "cool down operation", the "softness keeping operation" is not executed.

Figure 7:
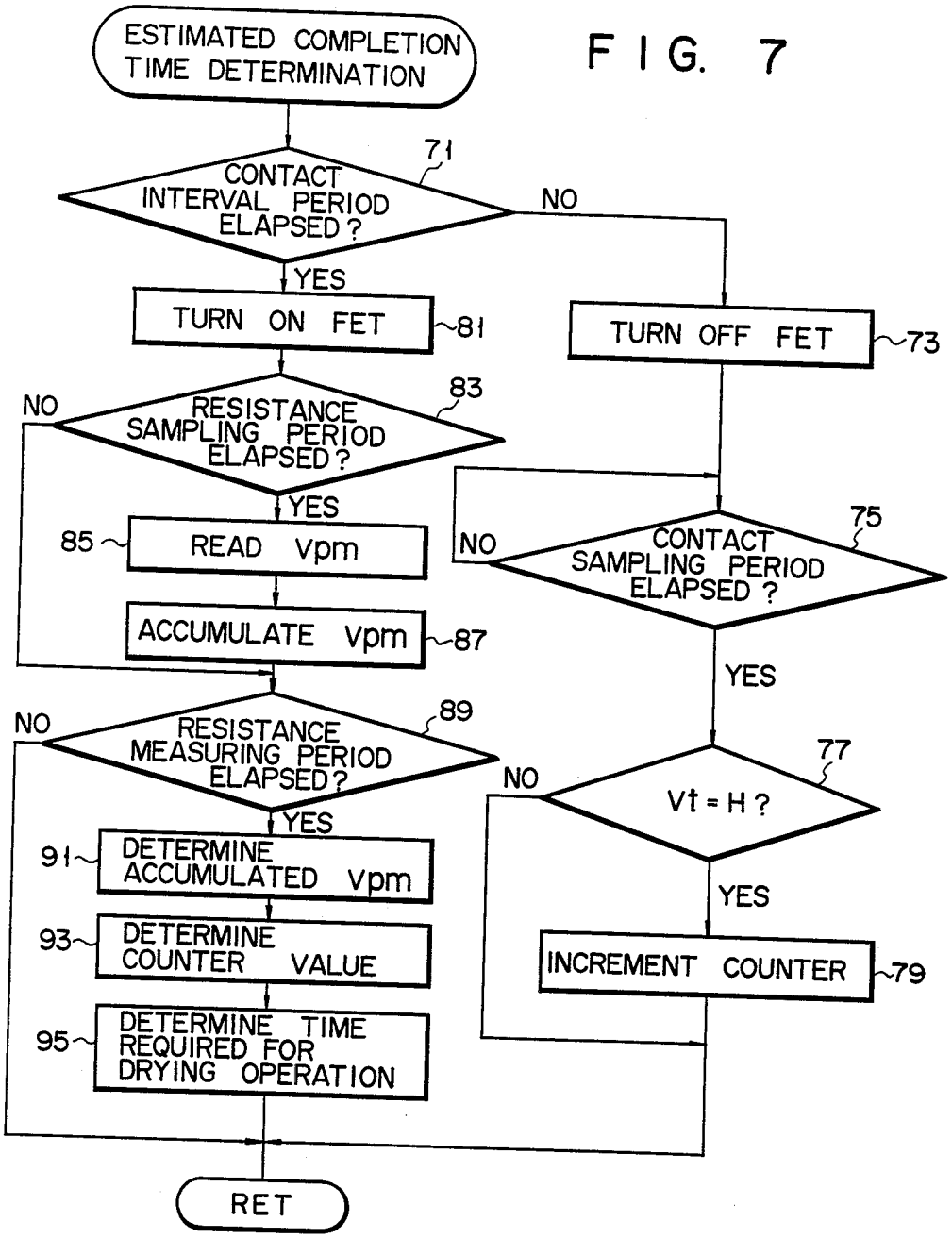

If an automatic operation course, e.g., a standard course, iron press course, and the like, other than the "timer course" is selected, since NO is obtained in step 51 in FIG. 6, the flow advances to "automatic operation start" step, and heaters 28 and 29 and motor 30 are energized to supply warm air flow into the drum while rotating it. Immediately thereafter, the flow advances to an "estimated operation time determination" subroutine 55, in this subroutine, a time required for the drying operation is determined as follows, and is displayed as an estimated time on time display unit 26. In the "estimated operation time determination" subroutine, as shown in FIG. 7, a contact interval of clothes to detection electrodes 21 is measured during a contact interval period. After the lapse of this period, the resistance of clothes is measured during a resistance sampling period. Then, a time required for the drying operation (i.e., estimated time) is determined based on the detected contact interval and the resistance. This operation will be described hereinafter in more detail.

(1) Measurement of Contact Interval

Figure 8:
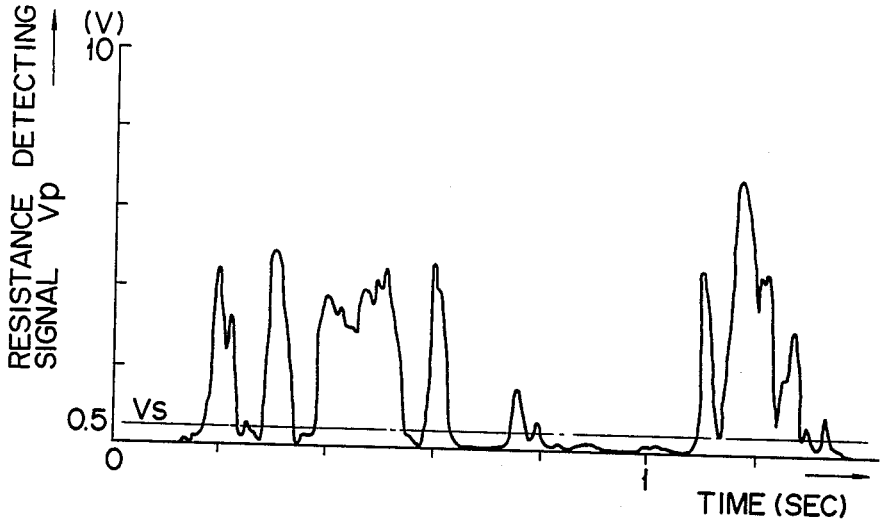

When the flow enters the "estimated operation time" subroutine 55, it is checked in step 71 in FIG. 7 if the contact interval period (e.g., 2 minutes) has elapsed. Since NO is obtained in step 71, FET 37 in converter 35 in detecting circuit 22 is turned off in step 73. Then, resistor 36 is removed from the circuit, and the detection resistance becomes several MΩwhich is sufficiently higher than the equivalent resistance (about 150 kΩ) of clothes at the beginning of the drying operation. As a result, each time the clothes contact detection electrodes 21, a voltage on line L+ divided by the equivalent resistance of the clothes and resistor 33 is input, as an output signal from detection electrode 21, to the non-inverting input terminal (+) of operational amplifier 34, and a voltage waveform, e.g., shown in FIG. 8, is output from the output terminal of operational amplifier 34 as resistance detecting signal Vp. Resistance detecting signal Vp is supplied to the noninverting input terminal (+) of operational amplifier 46 in detecting circuit 24. Therefore, High-level contact detecting signal Vt is output from the output terminal of operational amplifier 46 only when resistance detecting signal Vp exceeds reference voltage Vs supplied to the inverting input terminal (−) of operational amplifier 46. Note that reference voltage Vs is set to be about 0.1 to 1 V which is sufficiently lower than a peak value of resistance detecting signal Vp at the beginning of the drying operation (FIG. 8). Therefore, a period during which contact detecting signal Vt is output is substantially proportional to an interval during which the clothes contact detection electrodes 21. In other words, a ratio of time during which the clothes contact detection electrodes 21 in a unit time (in this specification, this is called a "contact interval") is proportional to a ratio of a time during which contact detecting signal Vt is output in a unit time.

In this embodiment, in step 75 in FIG. 7, control awaits for, e.g., 8 msec, and after the lapse of this time, the flow advances to step 77 to check if contact detecting signal Vt is at High level. If YES in step 77, a counter prestored in a RAM of microcomputer 25 is incremented (step 79). Thereafter, since NO is obtained in step 57 in FIG. 6, the flow returns to the beginning of the "estimated operation time determination" subroutine, and aforementioned steps are repeated until the contact interval period (e.g., 2 minutes) has elapsed. In this manner, when contact detecting signal Vt is generated from detecting circuit 24, the counter in microcomputer 25 is incremented every 8 msec. As a result, after the lapse of the contact interval period (2 minutes), the accumulation value of the counter represents a ratio of a time during which contact detecting signal Vt is generated in the period, that is, the contact interval of clothes to detection electrodes 21. When the contact interval period has passed and the measurement of the contact interval is completed, YES is obtained in step 71 in the "estimated operation time determination" subroutine, and the resistance of clothes is measured as follows.

(2) Measurement of Resistance

In step 81, FET 37 of converter 35 in detecting circuit 22 is turned on to insert resistor 36 in the circuit. As a result, the detection resistance becomes a low value, i.e., 20 kΩ. It is checked in step 83 in FIG. 7 if a resistance sampling period has elapsed. If NO in step 83, the flow advances to step 89 to check if a resistance measuring period has elapsed. At the beginning of resistance measurement processing, since the resistance measuring period has not yet been elapsed, NO is obtained in step 89, and the flow returns to step 57, i.e., to the beginning of the "estimated operation time determination" subroutine. If it is determined in step 83 that the sampling period (e.g., 10 sec) has elapsed, maximum value Vpm from peak hold circuit 23 is read from terminal A/D in step 85. Maximum value Vpm is A/D converted and accumulated in step 87. Accumulation of maximum value Vpm is repeated until YES is obtained in step 89. Maximum value Vpm read from peak hold circuit 23 every 10 sec is inversely proportional to the resistance of the clothes contacting detection electrodes 21 during this period. Therefore, since accumulated maximum value Vpm in the resistance measuring period is inversely proportional to the resistance of clothes during this period, the resistance of the clothes can be estimated based on the accumulated value. After the lapse of the resistance measuring period, YES is obtained in step 89 in FIG. 7, and the time required for the drying operation (estimated time) is determined as follows.

(3) Determination of Time Required for Drying Operation

Figure 10:
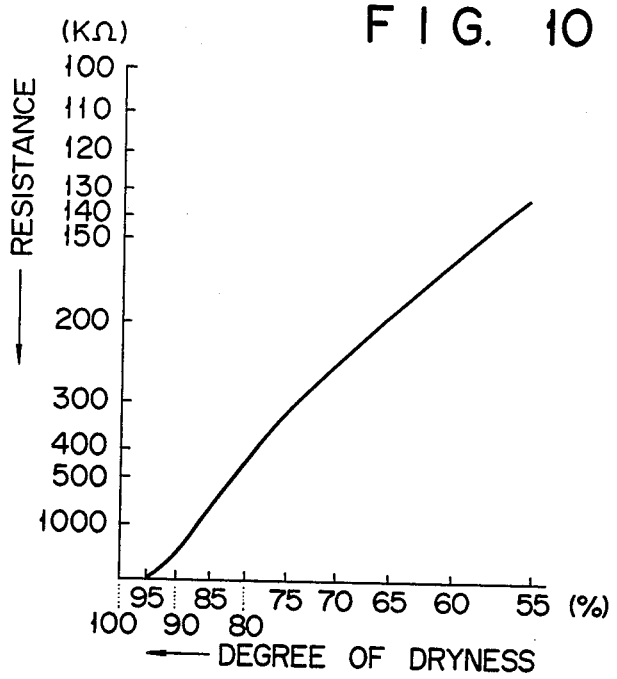

As shown in step 91 in FIG. 7, accumulated Vpm is determined. This amounts to determination of the resistance of the clothes, i.e., the degree of dryness. The relationship between the degree of dryness w of the clothes and the resistance between detection electrodes 21 was experimentally checked by the present inventors and is shown in FIG. 10. In FIG. 10, degree of dryness w [%] is defined to yield $w=(WO/W)\times 100$, where W is the volume of nondried clothes, and WO is the volume of dried clothes. It is apparent from FIG. 10 that as degree of dryness w increases, the resistance abruptly increases.

Figure 9:
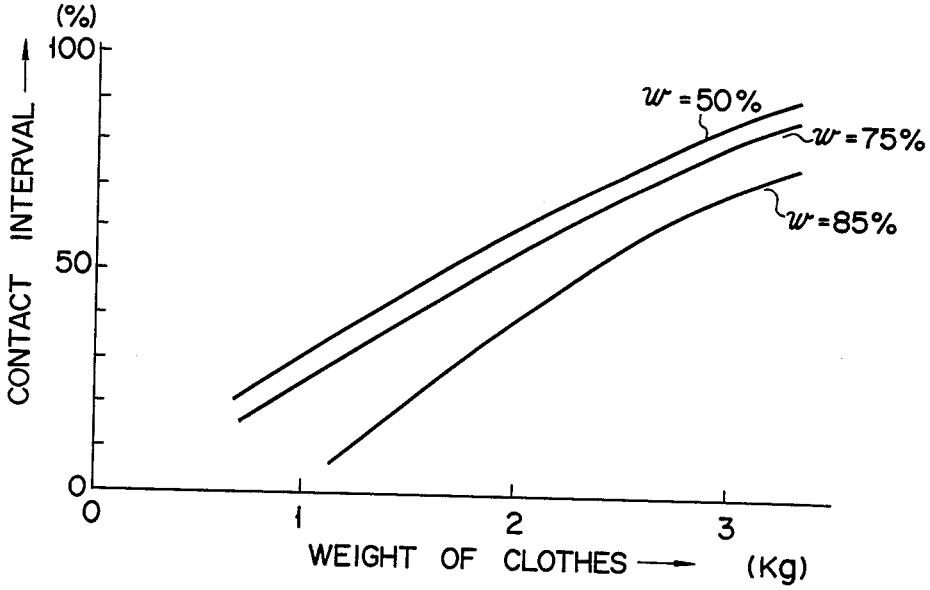

As shown in step 93 in FIG. 7, the counter accumulated value, i.e., the contact interval is determined. This means that the volume of clothes is determined. The relationship between the volume of clothes (the volume of dried clothes) and the contact interval was also checked by the present inventors, and FIG. 9 illustrates cases with degrees of dryness w of 50%, 75%, and 85%. When the degree of dryness falls in the range of 50 through 75%, the contact interval is not so influenced by the degree of dryness, and depends only on the volume of clothes. In general, since clothes dehydrated by a dehydrating machine have a degree of dryness falling in the range of 55 through 65%, the volume of clothes can be accurately estimated based on the contact interval.

Figure 11:
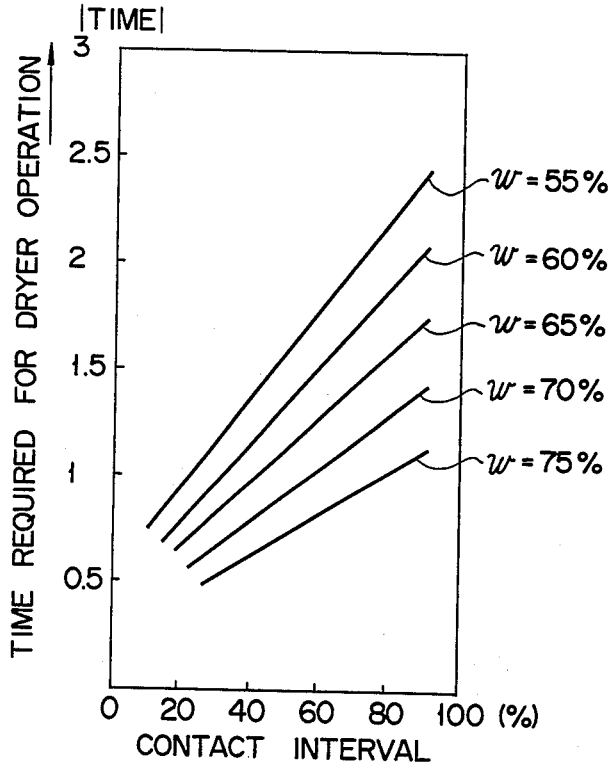

The time required for the drying operation is determined based on the contact interval and the resistance of the clothes determined as above. The relationship therebetween was also experimentally checked and the result is as shown in FIG. 11. This relationship is prestored in the ROM of microcomputer 25. In step 95 in FIG. 7, the time required for the drying operation is read out based on the already determined contact interval and degree of dryness w, and is determined as the estimated drying operation time. When the time required for the drying operation is determined as mentioned above, YES is obtained in step 57 in FIG. 6, and in step 59 the determined time is displayed on time display unit 26 as an estimated time. The "estimated drying operation time" is displayed while being decremented upon progress of the drying operation.

Thereafter, if the degree of dryness is determined not to have been detected (step 61), a "degree-of-dryness detecting" subroutine 63 is executed until the clothes have a predetermined degree of dryness (e.g., 90 to 95%). In the "degree-of-dryness detecting" subroutine, the degree of dryness is determined based on the resistance of clothes contacting detection electrodes 21.

The degree-of-dryness detecting subroutine will be described with reference to FIGS. 12 through 19.

More specifically, when the flow advances to the degree of dryness detection routine, count value tn of a subtraction internal counter is set to be a value corresponding to initial time Tz. Thereafter, decision step 97 forming a standby loop for a predetermined period M, timer subtraction step 99 for subtracting the preset time of an estimated time internal timer, and counter decrement step 101 for decrementing count value tn of the subtraction counter by one step are sequentially executed. In decision step 103 thereafter, it is checked if count value tn is zero. If NO in step 103, the flow returns to step 97. Therefore, a control loop for executing steps 97, 99, 101, and 103 is formed until count value tn reaches zero. If YES in step 103, peak voltage Vdp of detection voltage Vd is compared with comparison reference voltage Vr (in this case, iron press reference voltage Vr1 is set) in the next decision step 105. When $Vdp>Vr1$, the flow enters digital time value calculation subroutine 107. In digital time value calculation subroutine 107, input peak voltage Vdp is converted to digital time value Tn having a duration corresponding to its level. At this time, a conversion ratio to digital time value Tn is increased as the volume of clothes is smaller, on the basis of the relationships shown in FIGS. 13 and 14. In subsequent count value updating step 109, count value tn of the subtraction internal counter is converted to digital time value Tn converted as above. Thereafter, the flow returns to decision step 97 via peak hold cancel step 111 wherein ON instruction signal Son is supplied to transistor 44 to turn it on. When transistor 44 is turned on as described above, charges accumulated on capacitor 42 are quickly discharged, and holding of peak voltage Vdp is canceled.

Figure 15:
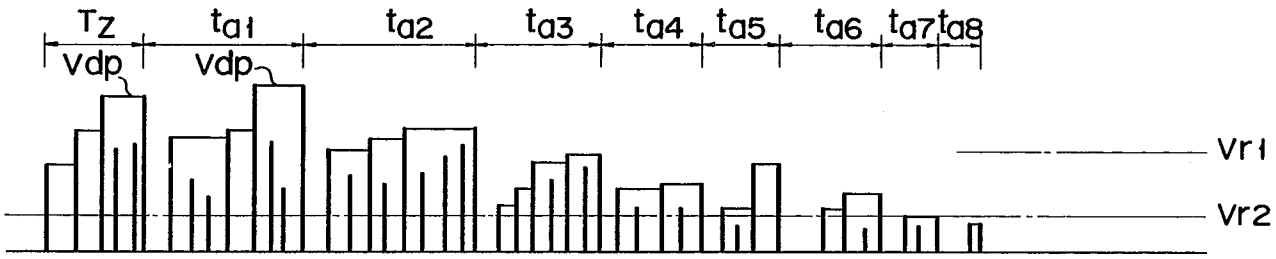
FIGS. 15 and 16 are charts showing an output state of the detection voltage in the flow chart shown in FIG. 12 in accordance with different volumes of clothes.
Figure 16:
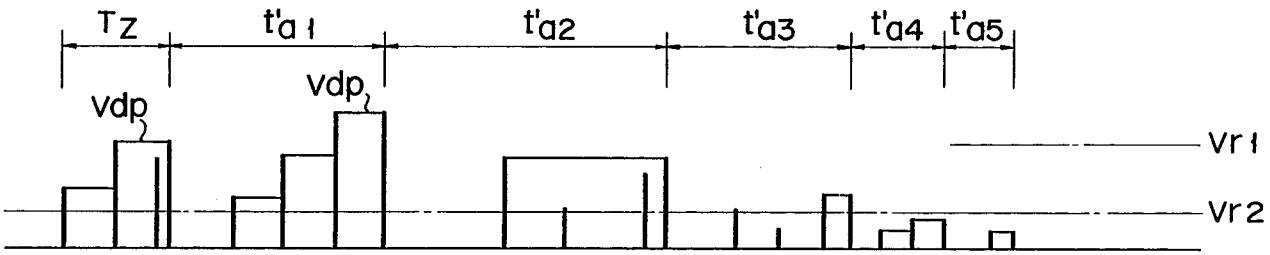

To summarize, when the above mentioned steps and subroutines 97 through 111 are repeatedly executed, peak voltage Vdp during a period until initial time has elapsed is held in operational amplifier 40, and is converted to digital time value Tn in this state. Then, this digital time value Tn updates count value tn of the subtraction internal counter and, thereafter, holding of peak voltage Vdp by peak hold circuit 23 is canceled. Thereafter, when a predetermined condition is established, in this case, when a time corresponding to count value tn stored as above has elapsed, digital time value tn obtained by newly converting peak voltage Vdp in this period updates count value tn of the subtraction internal counter, and holding of peak voltage Vdp by peak hold circuit 23 is canceled. In this manner, the above operation is repeated. Note that FIGS. 15 and 16 show time values ta1, ta2, . . . , and ta'1, ta'2, . . . , respectively, corresponding to updated count values tn when detection voltage Vd changes as shown therein (i.e., these figures show cases wherein the volume of clothes is relatively large and small, respectively).

In this way, when the degree of dryness of the clothes reaches a value suitable for iron press upon progress of hot air drying operation, detection voltage Vdp and iron press reference voltage Vr1 satisfy relation Vdp≦Vr1, and NO is obtained in decision step 105. Therefore, the flow advances to decision step 113 to check if iron press flag AF is "1". If NO in step 113, it is checked in decision step 115 if an "iron press course" is selected. If YES In step 115, completion detecting step 127 for outputting drying completion (predetermined degree of dryness detecting) signal Sx is executed to end the degree of dryness detecting subroutine. If NO in step 115, flag AF is set to be "1" in step 123, and the reference voltage is updated to Vr2 in step 125. In this manner, after steps 123 and 125 are executed, peak voltage Vdp and normal drying reference voltage Vr2 yield relation Vdp≦Vr2.

Until NO is obtained in step 105, steps 97 through 111 are repeatedly executed. Then, the flow advances to decision step 113 to obtain YES. In this case, the flow enters a drying operation setting routine 117. In this routine, the count value of a drying operation internal counter is set to be a value corresponding to the volume of clothes W, and the displayed content of display unit 26 is switched to have a time corresponding to the preset value. Thereafter, flag initialization step 119 for initializing iron press flag AF to be "0" and reference voltage initialization step 121 are executed, and completion detection step 127 for outputting drying completion signal Sx is executed to end the degree of dryness detecting subroutine.

Figure 17:
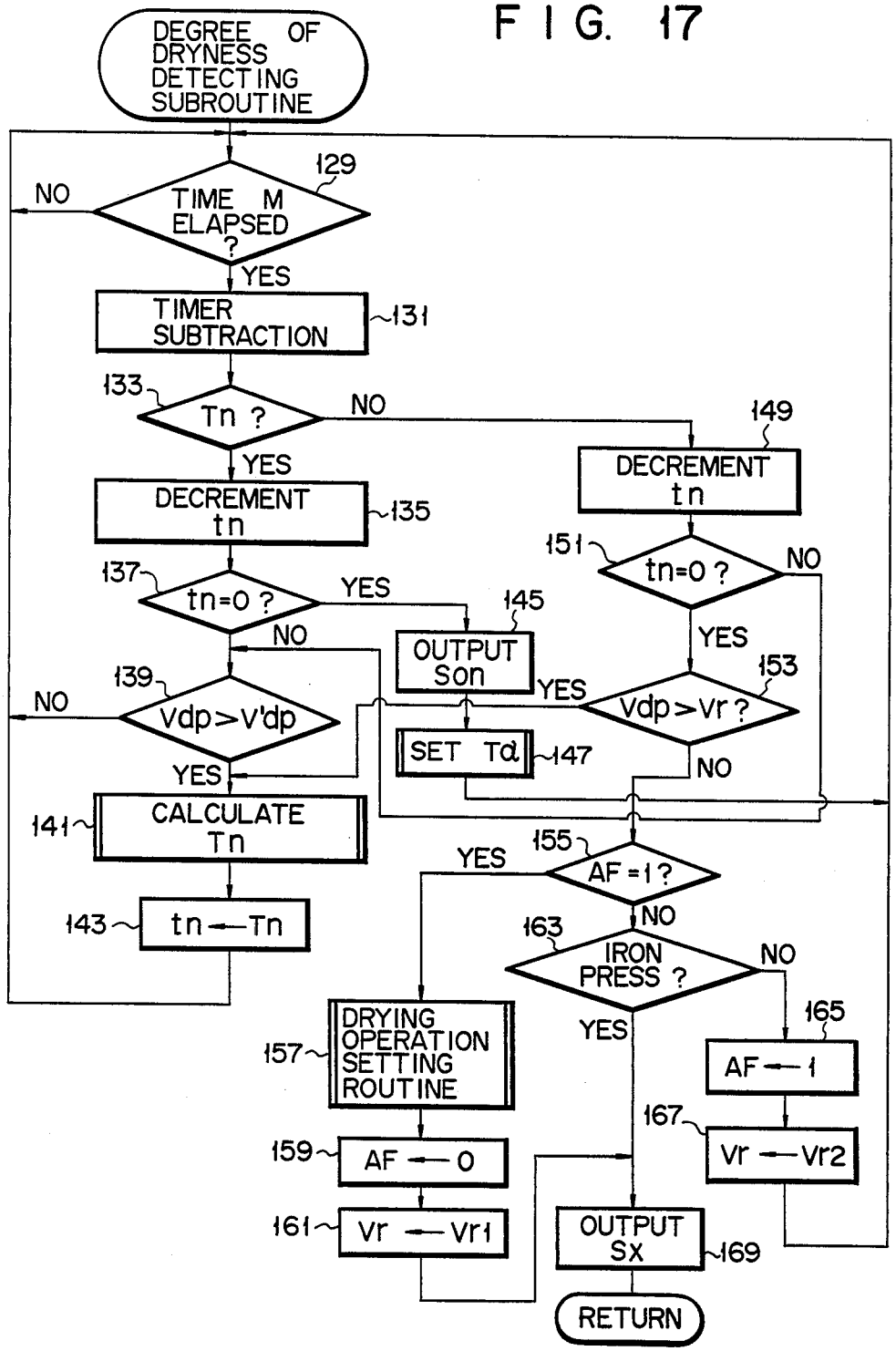
FIG. 17 is a flow chart showing a degree-of-dryness detecting subroutine shown in FIG. 6 in detail.
Figure 18:
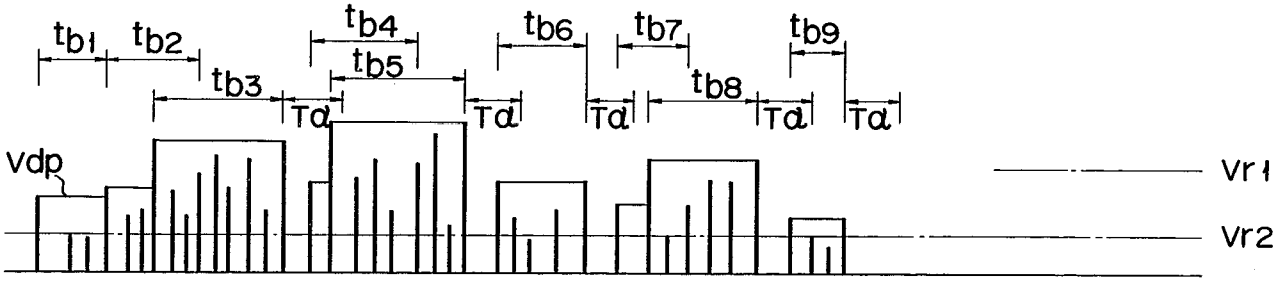
FIGS. 18 and 19 are charts showing an output state of the detection voltage in the flow chart shown in FIG. 17 in accordance with different volumes of clothes.
Figure 19:
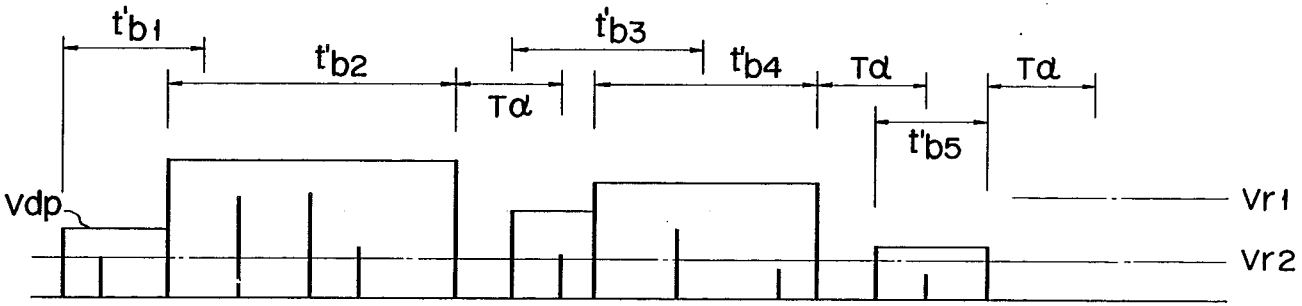

FIGS. 17 through 19 show another embodiment of the degree-of-dryness detecting subroutine providing the same effect as in the embodiment shown in FIGS. 12 through 16. The only differences between the subroutines in the first and second embodiments will now be described.

More specifically, the hardware arrangement of this embodiment is the same as that shown in FIG. 5, but microcomputer 25 stores a degree of dryness detecting subroutine shown in FIG. 17 instead of that in the embodiment shown in FIGS. 12 through 16.

Referring to FIG. 17, when the flow enters the degree of dryness detecting subroutine, count value tn of a subtraction internal counter is set to be an appropriate value equal to or larger than "2". Then, decision step 129 forming a standby loop for predetermined time M, and timer subtraction step 131 for subtracting the preset time of an estimated time internal timer are sequentially executed. Thereafter, the flow advances to decision step 133. In step 133, it is checked if count value tn set in the subtraction internal counter is digital time value Tn or sub digital time value Tα set in the following routine 147. In this case, YES is obtained in step 133, and counter decrement step 135 for decrementing count value tn of the subtraction counter is executed. In decision step 137 thereafter, it is checked if count value tn is zero. If NO in step 137, the flow advances to decision step 139. In step 139, it is checked if newly input peak voltage Vdp is larger than previously input peak voltage V'dp. If NO in step 139, the flow returns to step 129. If YES in step 139, in other words, if peak voltage Vdp larger than the previous one is input, digital time value calculation routine 141 for converting input peak voltage Vdp into digital time value Tn in the same manner as in the above embodiment, and count value updating step 143 for updating the count value tn of the subtraction internal counter to be digital time value Tn is executed. Thereafter, the flow returns to step 129. Therefore, until count value tn of the subtraction internal counter reaches zero, (i.e., until YES is obtained in step 137), the above steps and routines 129 to 143 are repeatedly executed. During this period, when peak voltage Vdp larger than the previous one is input, peak voltage Vdp is converted to digital time value Tn and updates count value Tn of the subtraction internal counter.

Thereafter, until count value tn of the subtraction internal counter is decremented to zero, if no conversion of new digital time value Tn is performed, YES is obtained in step 137, and peak hold canceling step 145 wherein ON instruction signal Son is supplied to transistor 44 to cancel holding of peak voltage Vdp by peak hold circuit 23 is executed. Then, the flow enters sub digital time value setting routine 147. In step 147, given sub digital time value Tα is set and stored as count value tn of the subtraction internal counter. Note that sub digital time value Tα is prolonged as weight (volume) of clothes W is smaller. After execution of sub digital time value setting routine 147, the flow returns to step 129. In this case, NO is obtained in step 133, and counter decrement step 149 for decrementing count value tn of the subtraction internal counter (corresponding to sub digital time value Tα) by one step is executed. Thereafter, the flow advances to decision step 151. In step 151, it is checked if count value tn is zero. If NO in step 151, the flow returns to step 139. Therefore, if peak a voltage Vdp larger than the previous one is input before a time corresponding to sub digital time value Tα elapses, digital time value Tn corresponding thereto updates count value tn of the subtraction internal counter. Thus, a control loop for executing steps and routines 129 through 143 is formed.

To summarize, when the above-mentioned steps and routines 129 through 151 are repeatedly executed, each time a predetermined condition is established, in this case, each time peak a voltage Vdp larger than the previous one is input, digital time value Tn corresponding thereto is calculated, and updates count value Tn of the subtraction internal counter. Thereafter, when no conversion of new digital time value Tn is performed and count value tn is decremented to zero, holding of peak voltage Vdp by peak hold circuit 23 is canceled, and given sub digital time value Tα updates count value tn. Thereafter, when a predetermined condition is established, in this case, when peak voltage Vdp larger than the previous one is input until a time corresponding to given count value tn has passed, digital time value Tn obtained by newly converting the peak voltage Vdp updates count value tn of the subtraction internal counter. Note that FIGS. 18 and 19 respectively show time values tb1, tb2, . . . , and tb'1, tb'2, . . . corresponding to updated count values tn when detection voltage Vd changes as shown therein (i.e., the figures show cases wherein the volume of clothes is relatively large and small, respectively, and also show time values corresponding to sub digital time values Tα.

When no conversion of new digital time value Tn is performed until count value tn (corresponding to digital time value Tα) is decremented to zero, YES is obtained in step 151, and the flow advances to decision step 153. In step 153, peak voltage Vdp is compared with iron press reference voltage Vr1 of reference voltages Vr. If Vdp>Vr1, the flow enters digital time value calculation routine 141, and the same operation as above is repeated.

Figure 12:
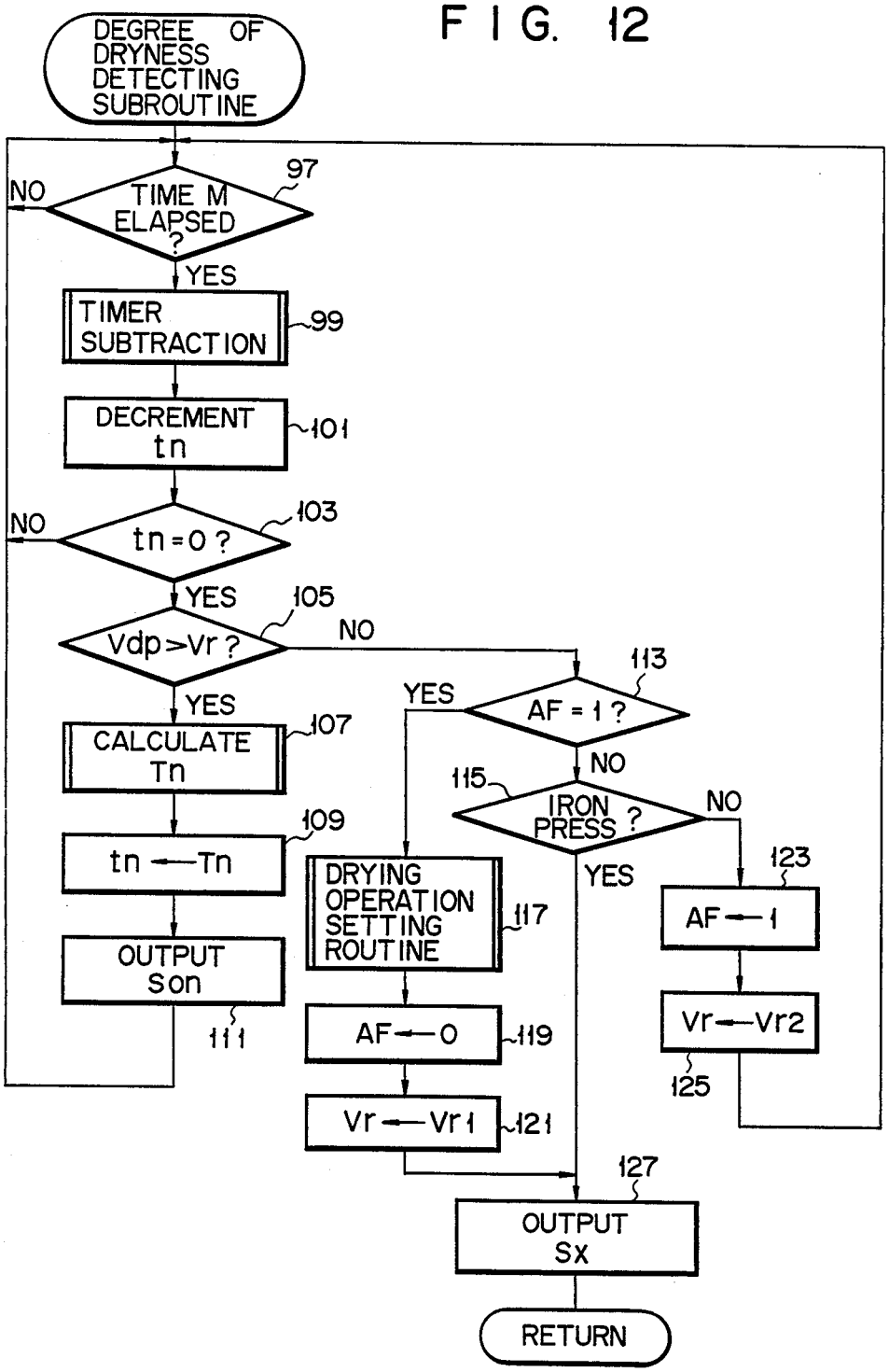
FIG. 12 is a flow chart showing a degree-of-dryness-detecting subroutine shown in FIG. 6 in detail.

If peak voltage Vdp and iron press reference voltage Vr1 yield relation Vdp≦Vr1 upon progress of the drying operation, and if NO is obtained in step 153, the flow advances to step 155 to check if iron press flag AF is "1". In step 155 and thereafter, the same decision step 163, flag updating step 165, reference voltage updating step 167, drying operation setting routine 157, flag initialization step 159, comparison reference voltage initialization step 161, and completion detecting step 169 as steps and routines 115, 123, 125, 117, 119, 121, and 127 in the degree of dryness detecting subroutine in FIG. 12 are executed. In particular, in step 169, completion detecting signal Sx is output, thus ending the degree of dryness detecting subroutine.

Note that at the end of the drying operation, FET 37 of converter 35 in detecting circuit 22 is turned off to remove resistor 36 from the circuit. Since the equivalent resistance of the clothes becomes high (on the order to MΩ) at the end of the drying operation, the detection resistance is preferably increased in order to enhance the precision of degree-of-dryness detection. If it is detected in the degree-of-dryness detecting subroutine that the clothes have reached a predetermined degree of dryness, control sequentially enters a "final drying operation", a "cool down operation" (step 65 in FIG. 6), and a "softness keeping operation", step 65 and is then ended. The "finishing drying operation" is performed such that heaters 28 and 29 and motor 30 are energized upon control of time. This time is set to be larger as the contact interval of clothes to detection electrodes 21, i.e., the volume of clothes is larger.

A third embodiment of the present invention will now be described.

Figure 20:
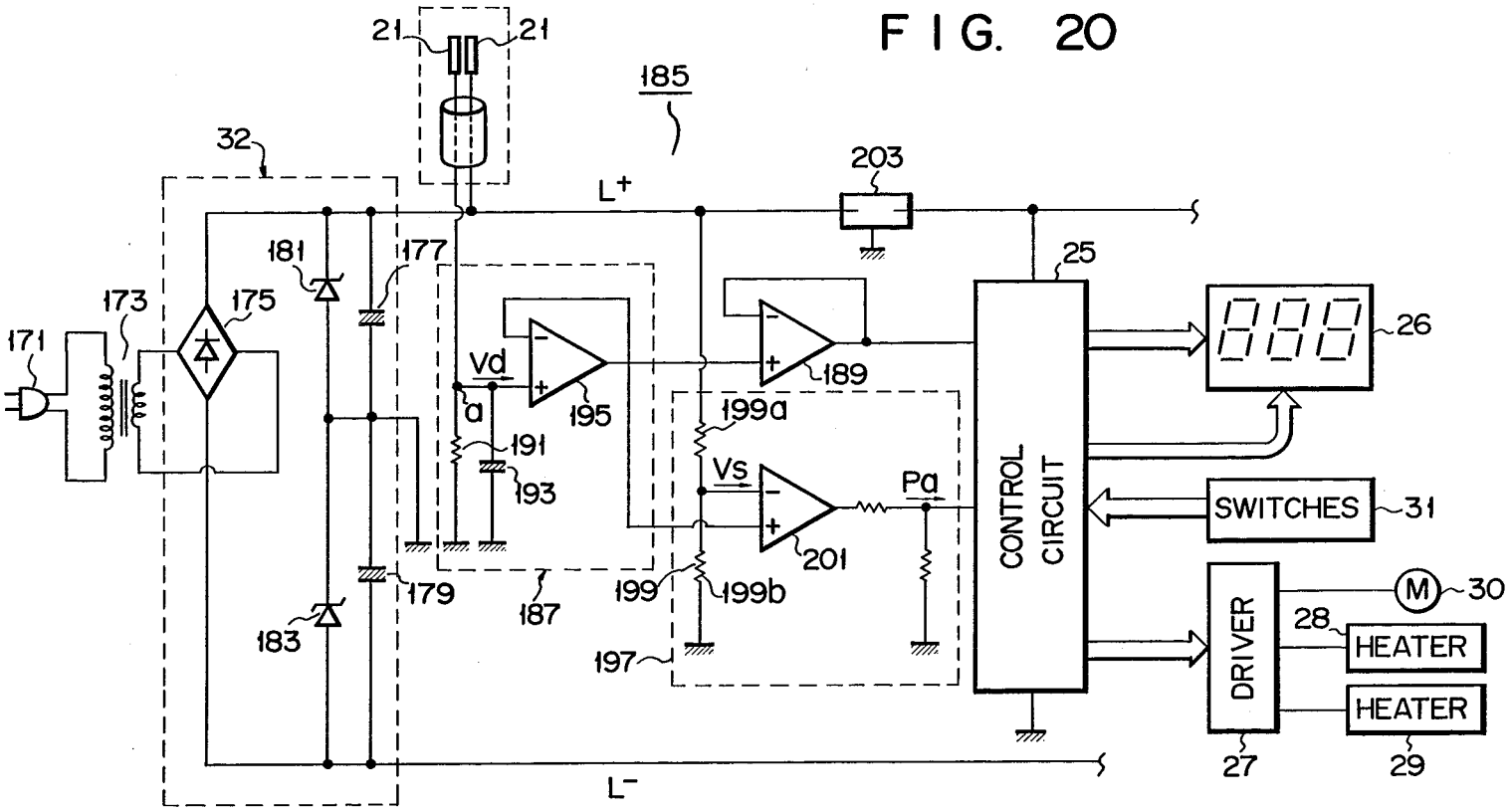
FIG. 20 is a block diagram showing still another embodiment of the present invention.
Figure 21:
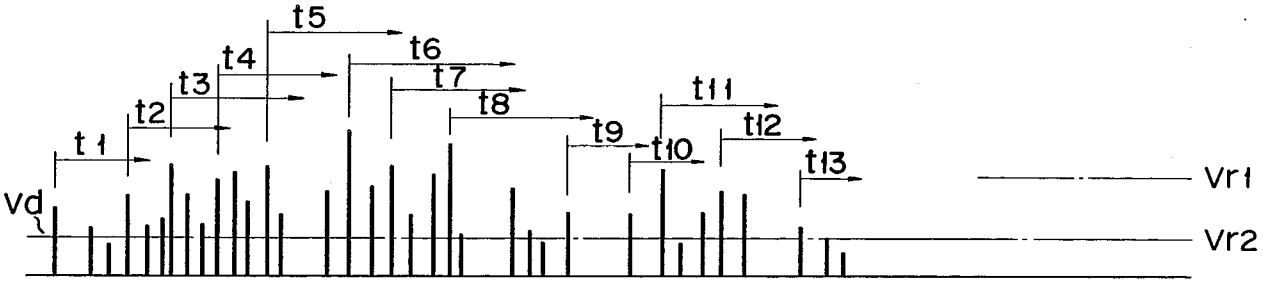
FIGS. 21 and 22 are charts showing an output state of the detection voltage in the embodiment shown in FIG. 20 in accordance with different volumes of clothes.
Figure 22:
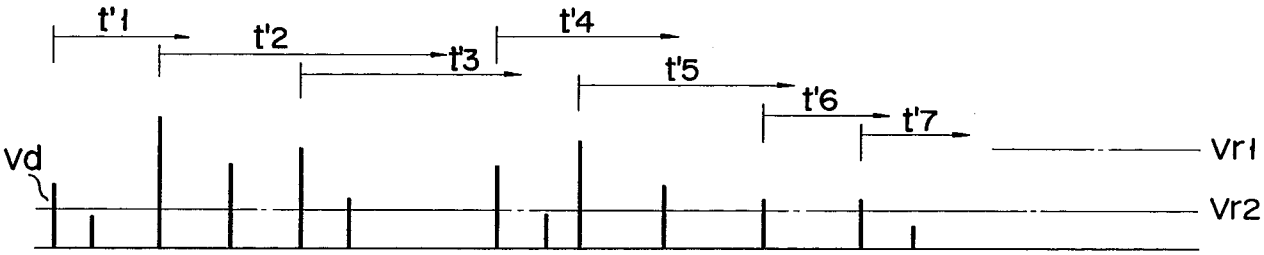

Referring to FIG. 20, reference numeral 32 denotes a DC power supply circuit (rectifier circuit) having positive and negative output lines L+ and L−. DC power supply circuit 32 includes transformer 173 for decreasing an AC power supply output applied thereto through power supply plug 171, rectifier 175 and smoothing capacitors 177 and 179 for rectifying and smoothing a secondary output of transformer 173, and constant voltage diodes 181 and 183. Reference numeral 185 denotes an instantaneous value detecting circuit, which includes a pair of electrodes 21, voltage converter 187, and buffer amplifier 189. Electrodes 21 are arranged on an appropriate stationary portion in a rotary drum (not shown) so as to intermittently contact clothes stirred in the rotary drum. One electrode 21 is connected to output line L+, and the other electrode 21 is connected to a ground line through a parallel circuit of resistor 191 and capacitor 193 of voltage converter 187. Therefore, detection voltage Vd shown in FIG. 21 inversely proportional to an instantaneous resistance of clothes contacting electrodes 21 intermittently appears at common node a of electrode 21 and resistor 191, and is output through buffer amplifier 195 in converter 187 and buffer amplifier 189. Note that FIG. 21 shows an output state of detection voltage Vd when the weight of clothes in the rotary drum is relatively large, and FIG. 22 shows an output state of detection voltage Vd when the weight of clothes in the rotary drum is relatively small.

Reference numeral 197 denotes a contact detecting circuit for detecting contacting of clothes to electrodes 21. Contact detecting circuit 197 includes reference voltage generator 199 constituted by connecting resistors **199*a* and 199*b* between output line L+ and the ground line, and comparator 201 for comparing reference voltage Vs from reference voltage generator 199 with detection voltage Vd from converter 187. Therefore, comparator 121 outputs detection pulse Pa which rises upon contacting of clothes to electrodes 21**.

Reference numeral 25 denotes a control circuit (microcomputer) having both the functions of calculation storage means and degree of dryness detecting means of the present invention as in the embodiment shown in FIG. 4. Microcomputer 25 is powered by DC power supply circuit 32 via stabilization power supply circuit 203. Microcomputer 25 receives detection voltage Vd from detecting circuit 185 and detection pulse Pa from detecting circuit 197, and also receives an operation signal from key switches 31 for external operation. Microcomputer 25 controls digital display 26 for displaying a remaining time of a drying operation in accordance with the above input signals and a prestored control program, and also controls motor 30 for driving the rotary drum and a blowing fan and heaters 28 and 29 for the drying operation. Note that reference numeral 27 denotes a driver for driving motor 30 and heaters 28 and 29. In this embodiment, the drying operation executed by microcomputer 25 includes a "timer operation course" for controlling an operation time of a hot air drying operation by a timer incorporated in microcomputer 25 and an "automatic operation course" for controlling the operation time based on a detected degree of dryness of clothes. The "automatic operation course" is further divided into an "iron press course" and a "normal operation course". Selection of these courses and setting of the operation time when the timer operation course is selected are performed by key switches 31.

A portion of the control program prestored in microcomputer 25 associated with this aspect of the present invention will be described hereinafter with reference to FIGS. 13, 14, and 23 through 25.

Figure 23:
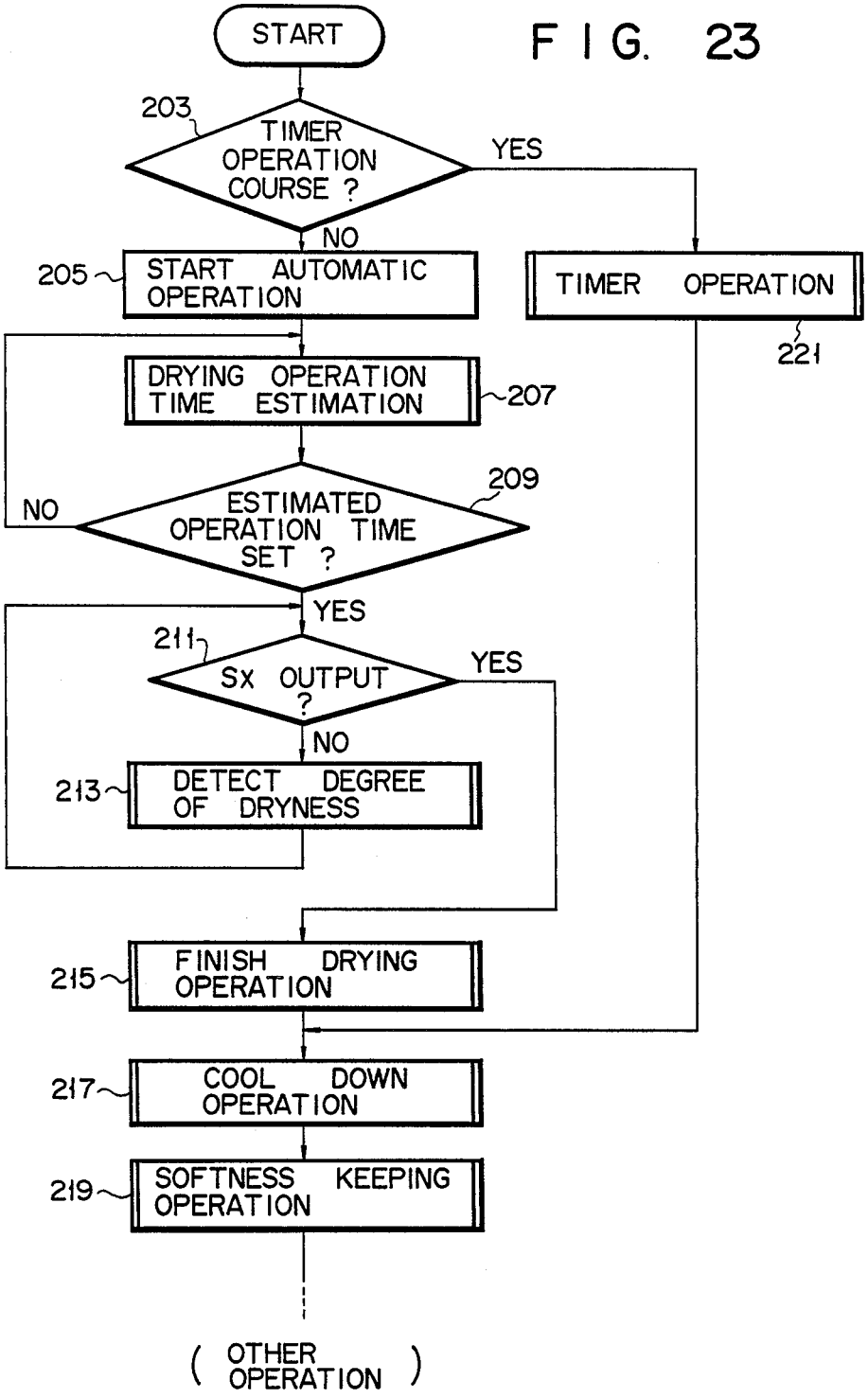
FIG. 23 is a flow chart showing the entire control program executed by a control circuit in the embodiment shown in FIG. 20.

FIG. 23 schematically shows the entire control program. Referring to FIG. 23, it is checked in decision step 203 if a "timer operation course" is selected. If YES in step 203, timer operation execution routine 221 is executed. In routine 221, a time obtained by subtracting a time required for a cool down operation from an operation time set by key switches 31 is set in a drying operation internal timer included in a RAM (not shown). Motor 30 and heaters 28 and 29 are driven until the time set in the timer has elapsed, thereby executing a hot air drying operation. Thereafter, the flow enters a cool down operation execution routine 217. In routine 217, only motor 30 is driven so as to execute the cool down operation until a predetermined cool down operation time has elapsed. Thereafter, the flow enters the softness keeping operation execution routine 219. In routine 219, motor 30 is intermittently driven in a relatively long cycle, thus keeping dried clothes soft. The softness keeping operation is stopped upon input of a completion instruction signal from key switches 31 or upon opening/closing of a door for picking up clothes. In routines 221 and 217, the operation time set by key switches 31 is displayed on display unit 26, and the displayed content is sequentially decremented upon progress of the drying operation.

If NO in step 203, in order words, if the "automatic operation course" is selected, motor 30 and heaters 28 and 29 are driven to start the hot air drying operation in automatic operation start step 205. Thereafter, drying operation time estimation routine 207 and decision step 209 are sequentially executed.

Figure 24:
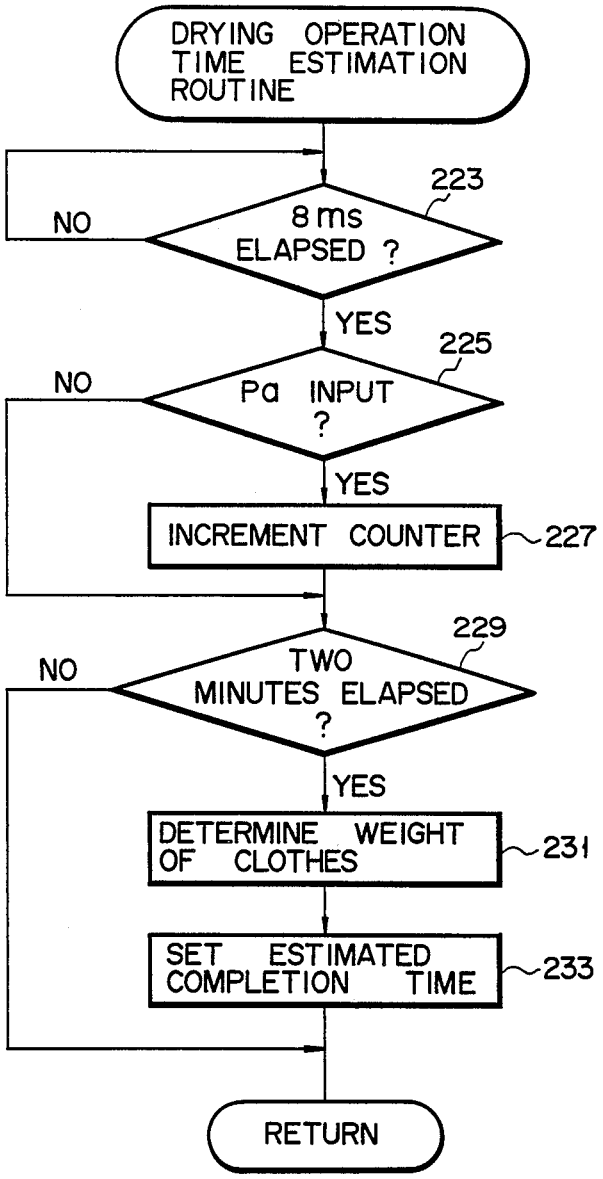
FIG. 24 is a detailed flow chart of a drying operation time estimation subroutine shown in FIG. 23.

Drying operation time estimation routine 207 is executed as shown in FIG. 24. More specifically, in decision step 223, a standby loop for, e.g., 8 msec, is formed, and it is then checked in decision step 225 if detection pulse Pa from detecting circuit 197 is input. If YES in step 225, counter increment step 227 for incrementing an estimation internal counter in the RAM (not shown) by one step is executed, and the flow then advances to decision step 229. However, if NO in step 225, the flow jumps to step 229 without executing step 227. In step 229, it is checked if a predetermined determination time, e.g., 2 minutes, has elapsed. If NO in step 229, the flow jumps to decision step 209 shown in FIG. 23 without executing weight (volume) of clothes determination step 231 and estimated operation time setting step 233. In step 209, it is checked if an estimated operation time is set in estimated operation time setting step 233. In this case, since step 233 is omitted, NO is obtained in step 209, and the flow returns to the start address of the drying operation time estimation routine.

When 2 minutes have elapsed from the beginning of the drying operation time estimation routine, YES is obtained in step 229, and the flow advances to step 231. Since a loop for executing steps 223, 225, 227, and 229 is formed for 2 minutes, the count value of the estimation internal counter corresponds to an accumulated value of the pulse width of detection pulse Pa in 2 minutes, i.e., a contact interval of clothes to electrodes 21 in unit time. The obtained contact interval has a given correspondence with the volume of clothes in the rotary drum, and hence, the volume of clothes can be relatively accurately determined in accordance with the count value of the estimation internal counter. In step 231, the count value of the estimation internal counter is compared with various prestored reference values, so that weight of clothes W in the rotary drum is determined in accordance with the comparison result. In step 233, a remaining time of the drying operation is calculated in accordance with determined weight of clothes W, the calculation result is set in an estimated time internal timer in the RAM (not shown), and the set content is displayed on display unit 26.

After step 233 is executed as described above, YES is obtained in step 209, and the flow advances to decision step 211. In step 211, it is checked if drying completion signal Sx is output. At this time, since no signal Sx is output, a degree-of-dryness detecting routine shown in FIG. 25 is executed.

Figure 25:
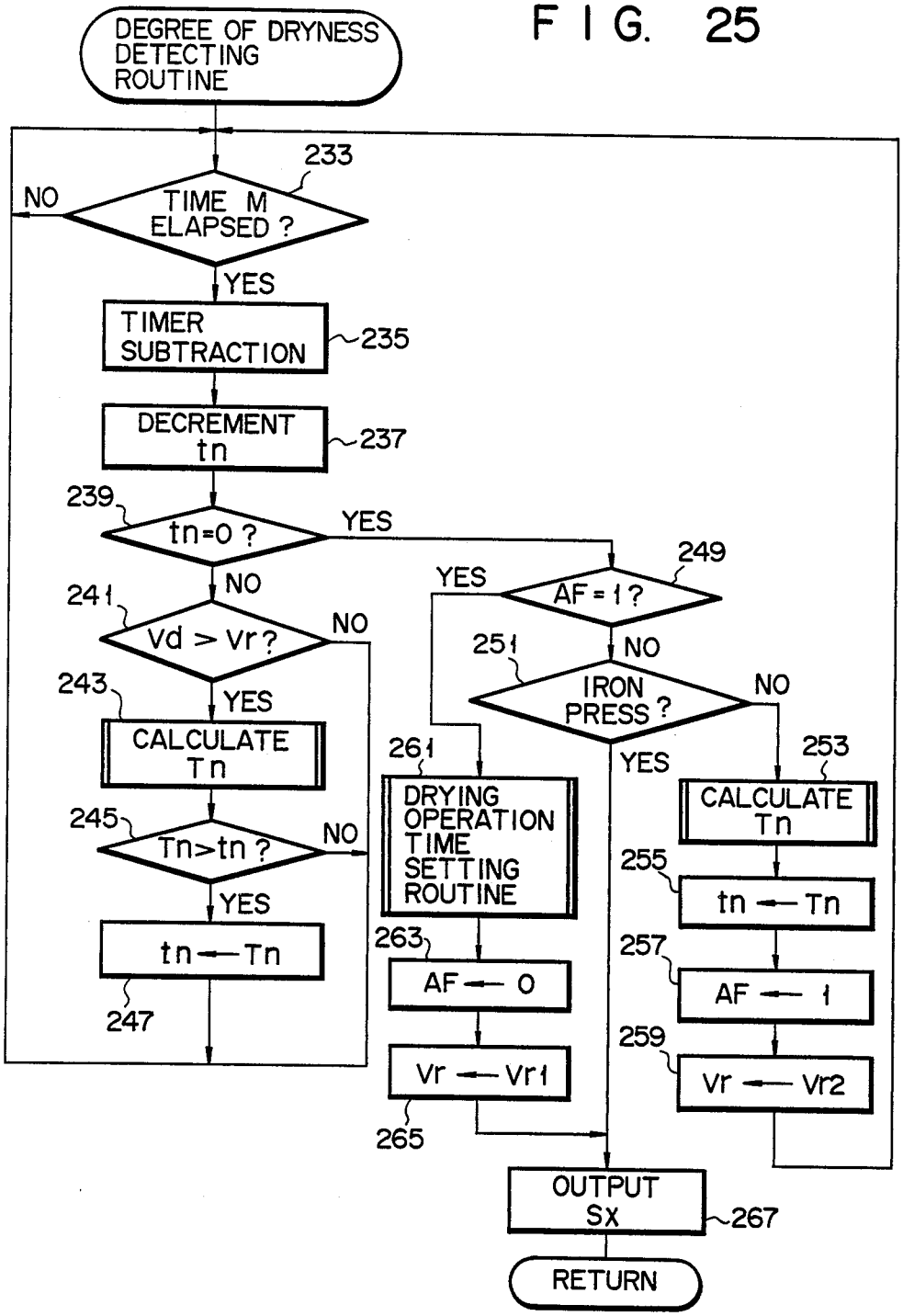
FIG. 25 is a detailed flow chart of a degree-of-dryness-detecting subroutine shown in FIG. 23.

FIG. 25 shows the degree of dryness detecting routine in detail, and this routine will be described below. When the flow enters this routine, count value tn of a subtraction internal counter (not shown) in the RAM is preset to be an appropriate value equal to or larger than "2" and, then, decision step 233 is executed. In step 233, a standby loop for predetermined time M is formed, and a preset time in the estimated time internal timer is subtracted in timer subtraction step 235. Therefore, upon repetitive execution of step 235, the displayed content of display 26 is gradually decremented.

Thereafter, in counter decrement step 237, count value tn of the subtraction internal counter is decremented by one step, and the flow advances to decision step 239. In step 239, it is checked if count value tn is zero. At this time, since tn $>0$, NO is obtained in step 239, and the flow advances to decision step 241. In step 241, detection voltage Vd supplied from detecting circuit 185 is compared with predetermined comparison reference voltage Vr (in this case, iron press reference voltage Vr1 is set, as can be seen from the following description). If $Vd>Vr$ ($=Vr1$), the flow advances to digital time value calculation routine 243.

Figures 13, 14:
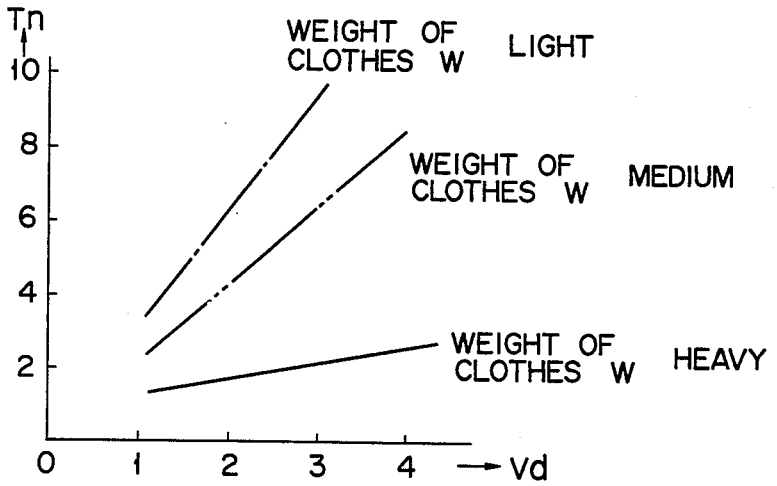
FIGS. 13 and 14 are charts showing a conversion ratio of a detection voltage to a digital time value.

In routine 243, input detection voltage Vd is converted to digital time value Tn having a duration corresponding to its level. In this case, a conversion ratio varies in accordance with weight of clothes W determined in step 231, as shown in FIGS. 13 and 14. More specifically, as can be seen from FIGS. 13 and 14, as weight (volume) of clothes W is smaller, the conversion ratio to digital time value Tn increases.

After digital time value Tn is obtained in this manner, digital time value Tn is compared with count value tn of the subtraction internal counter in decision step 245. If $Tn>tn$, count value updating step 247 for updating count value tn of the subtraction internal counter to be digital time value Tn converted as above is executed. Then, the flow returns to step 233. If it is determined in step 245 that $Tn \leqq tn$, the flow returns to step 233 without executing step 247. Steps and routines 233 through 247 are repetitively executed until count value tn of the subtraction internal counter becomes zero (i.e., until YES is obtained in step 239). More specifically, digital count value obtained by converting detection voltage Vd, i.e., count value tn, is gradually decremented. Thereafter, each time a predetermined condition is established, in this case, each time digital time value Tn longer than the decremented count value tn is updated, digital time value Tn updates count value tn of the subtraction internal counter. In this manner, the above operation is repeated. Note that FIGS. 21 and 22 respectively show time values t1, t2, . . . and t'1, t'2, . . . corresponding to updated count value tn when detection voltage Vd changes as the figures shown therein (i.e., show cases wherein weight of clothes W is relatively large and small, respectively).

The degree of dryness of clothes increases upon progress of the hot air drying operation. While the degree of dryness reaches a value suitable for iron press, since detection voltage Vd and iron press reference voltage Vr1 provide relation Vd>Vr1, digital time value Tn is repeatedly updated in step 247. Therefore, during this period, NO is kept obtained in step 241. Thereafter, when the hot air drying operation further progresses and the degree of dryness of clothes has reached a value suitable for iron press, in other words, when Vd≦Vr1, digital time value Tn is no longer updated in step 247. Thus, when a time corresponding to finally updated digital time value Tn has elapsed, count value tn becomes zero. As a result, YES is obtained in step 239, and the flow advances to decision step 249. It is checked in step 249 if iron press flag AF is "1". In this case, as will be apparent from the following description, since AF=0, NO is obtained in step 249, and the flow advances to step 251. It is checked in step 251 if an "iron press course" is selected by key switches 31. If YES in step 251, completion detecting step 267 for outputting drying completion signal Sx is executed to end the degree-of-dryness detecting routine. Then, the flow returns to step 211 in FIG. 23. If NO in step 251, in other words, if a "normal drying operation course" is selected, new digital time value Tn is obtained in digital time value calculation routine 253 similar to routine 243, and updates count value tn of the subtraction internal counter in count value updating step 255.

Thereafter, the flow returns to step 233 via flag updating step 257 for updating flag AF to be "1" and reference voltage updating step 259. In step 259, reference voltage Vr in step 241 is updated from iron press reference voltage Vr1 to normal drying reference voltage Vr2 (Vr2<Vr1). As described above, steps and routines 253 through 259 are executed, and NO is obtained in step 239 to execute decision step 241 again. At this time, detection voltage Vd is compared with normal drying reference voltage Vr2. Therefore, in this case, while the degree of dryness of clothes reaches an operation completion value of the normal drying operation course, new digital time value Tn is repetitively updated in step 247. Thereafter, when the hot air drying operation further progresses and the degree of dryness of clothes has reached the operation completion value, in other words, when Vd≦Vr2, digital time value Tn is no longer updated in step 247. Therefore, when a time corresponding to finally updated digital time value Tn has elapsed, count value tn becomes zero, and then, the flow advances from step 239 to step 249. At this time, since flag AF is "1", YES is obtained in step 249, and the flow enters finishing drying operation time setting routine 261. In routine 261, the count value of the drying operation internal counter is set to be a predetermined value corresponding to weight of clothes W, and the displayed content of display 26 is switched to have a time corresponding to the preset value. Thereafter, flag initialization step 263 for initializing flag AF to "0", reference voltage initialization step 265 for initializing comparison reference voltage Vr to be iron press reference voltage Vr1, and completion detecting step 267 are executed to complete the drying state detecting routine. Then, the flow enters finishing drying operation execution routine 215 shown in FIG. 23.

In routine 215, the hot air drying operation is executed within a time set by finishing drying operation time setting routine 261. Thereafter, cool down operation execution routine 217 and softness keeping operation execution routine 219 are sequentially executed.

Control circuit 25 executes the timer operation course and the automatic operation course in this manner. According to this embodiment, detection voltage Vd obtained as data representing the degree of dryness of clothes in the rotary drum is converted to digital time value Tn, digital time value Tn is stored as count value tn, and count value tn is gradually decremented upon progress of the hot air drying operation. Count value tn changes as the degree of dryness increases upon progress of the hot air drying operation. Therefore, count value tn can be used as data accurately representing the degree of dryness of clothes. Count value tn is stored until it is decremented to zero, and each time a digital time value Tn longer than count value tn is supplied, digital time value Tn updates count value tn. In other words, each time the wet portion of clothes contacts electrodes 21 and High-level detection voltage Vd is supplied, digital time value Tn corresponding to voltage Vd is stored as count value tn. Therefore, although clothes do not always contact electrodes 21 and detection voltage Vd is intermittently generated, the degree of dryness of the wet portion of clothes can be accurately detected, and an output timing of drying completion signal Sx can be accurately determined, thus improving the detection precision of the degree of dryness. In addition, since signal processing is performed such that detection voltage Vd is converted to digital time value Tn, reliability against aging can be improved and the detection precision can be maintained over a long period of time unlike a case wherein detection voltage Vd is charged on and stored in, e.g., a capacitor.

According to this embodiment, the volume of clothes in the rotary drum is determined based on detection pulse Pa from detecting circuit 197. As the determined volume of clothes is small, digital time value Tn is automatically prolonged. Thus, even when the drying operation is performed with a light weight (a small volume) of clothes in the rotary drum and an output interval of detection voltage Vd is prolonged, count value tn can be held not to be decremented to zero during the output interrupt period, thus improving the degree-of-dryness detection precision even in the case of a light weight (a small volume) of clothes.

In this manner, an instantaneous resistance of clothes obtained between electrodes changes in accordance with the degree of dryness of clothes, and hence, a digital time value stored in a storage means represents the degree of dryness of clothes. The degree of dryness of clothes increases upon progress of the drying operation. However, since a calculation storage means sequentially decrements the digital time value, the decremented digital time value can correspond to a change in degree of dryness. As a result, an output timing of the drying completion signal based on the digital time value can be accurately determined. The calculation storage means stores the decremented digital time value within a time required for subtraction, and each time it receives a new digital time value longer than the decremented digital time value, it updates the digital time value. Therefore, although the clothes intermittently contact the electrodes, a state equivalent to that wherein a change in degree of dryness is successively detected can be obtained, thus improving the degree-of-dryness detection precision.

With this embodiment, since a time required for the drying operation ("estimated drying operation time") is determined based on the contact interval of clothes to electrodes 21 and their resistance detected at that time, very quick determination can be achieved when compared with a conventional method based on the rate of increase in exhaust temperature after a predetermined period of drying operation. Therefore, the "estimated drying operation time" can be signaled to the user earlier, resulting in convenience. In addition, since the contact interval and the resistance are not influenced by ambient temperature, humidity, a power supply voltage (amount of heat from a heater), or the like, an estimation precision can be greatly improved.

In this embodiment, a time required for the drying operation is determined based on both the contact interval of clothes to detection electrodes 21 and their resistance. However, the present invention is not limited to this. Since degrees of dryness of clothes dehydrated by a dehydrating machine are not so different from each other, estimation can be made based on only the contact interval of clothes. Alternatively, since the determination precision of volume of clothes is better at the beginning of the drying operation, the operation time is estimated based on only the contact interval at the beginning of the drying operation, and is reestimated based on both the contact interval and the resistance in the middle of the drying operation to correct a displayed value. Furthermore, the operation time is reestimated based on the resistance at the end of the drying operation to recorrect the displayed value.

Moreover, the present invention is not limited to estimation based on the contact interval. For example, resistance detecting signal Vp is sampled in a short period of time, e.g., 10 through 20 msec and is A/D converted and stored. Then, if the sampled detecting signals are integrated for a predetermined period of time, the integrated value is proportional to the resistance and volume of clothes, and a time required for the drying operation can be accurately estimated as in the second embodiment. In this case, in order to detect an accurate resistance as much as possible, the detection resistance of resistance detecting circuit 22 is preferably a small value approximate to an equivalent resistance of clothes at the beginning of the drying operation. When an estimated time is displayed by decrementing, its decrementing unit is initially set to be 10 minutes, and after control enters the finishing drying operation under time control, the decrement unit can be 1 minute. The present invention is not limited to the particular embodiments described above and illustrated in the drawings. For example, the estimated time need not be visually displayed but can be generated as a synthesized voice.

In the above embodiments, control circuit 25 incorporates a function for converting detection voltage Vd or its peak voltage Vdp to digital time value Tn. However, an analog-to-digital converter or the like can be separately provided to obtain digital time value Tn. Control circuit 25 incorporates the drying operation internal timer, the subtraction internal timer, and the like utilizing its RAM. However, these timers or counters can be arranged by an external circuit of control circuit 25, as a matter of course.

What is claimed is:

1. A drying machine comprising:

at least one detection electrode provided in a drum constituting a drying chamber, said electrode capable of contacting clothes in said drum;

volume-of-clothes detection means for detecting a volume of clothes in said drum based on a degree of contact of the clothes to said detection electrode upon rotation of said drum;

means for calculating an estimated time required for a drying operation based on the volume of clothes detected by said volume-of-clothes detection means; and estimated time display means for displaying the estimated time calculated by said means for calculating the estimated time.

2. A drying machine according to claim 1, further comprising:

degree-of-dryness setting means, operable by a user, for selectively setting a plurality of target degrees of dryness;

degree-of-dryness detection means for detecting a degree of dryness of clothes in accordance with a resistance of clothes contacting said detection electrode;

remaining operation time determination means for determining a remaining operation time based on the target degree of dryness set by said degree-of-dryness setting means and the detected degree of dryness detected by said degree-of-dryness detection means; and remaining operation time displaying means for displaying the remaining operation time determined by said remaining operation time determination means.

3. A drying machine according to claim 1, further comprising:

degree-of-dryness setting means, operable by a user, for selectively setting a plurality of target degrees of dryness;

degree of dryness detection means for detecting a degree of dryness of clothes in accordance with a resistance of clothes contacting said detection electrode;

remaining operation time determination means for determining a remaining operation time based on the volume of clothes detected by said volume-of-clothes detection means, the target degree of dryness set by said degree-of-dryness setting means and the detected degree of dryness detected by said degree-of-dryness detection means; and remaining operation time displaying means for displaying the remaining operation time determined by said remaining operation time determination means.

4. A drying machine according to claim 2, further comprising subtraction means for sequentially decrementing the remaining operation time determined by said remaining operation time determination means, the subtraction result of said substraction means being displayed on said remaining operation time displaying means.

5. A drying machine according to claim 3, further comparing subtraction means for sequentially decrementing the remaining operation time determined by said remaining operation time determination means, the subtraction result of said subtraction means being displayed on said remaining operation time displaying means.

6. A drying machine according to claim 2, wherein said degree-of-dryness detection means comprises:

instantaneous value detection means for detecting an instantaneous resistance of said detection electrode;

means for converting the detected instantaneous value into a digital time value having a duration corresponding thereto;

digital time value storage means for storing the digital time value;

calculation means for decrementing the digital time value from said digital time value storage means and updating the digital time value each time a predetermined condition is established so as to store the updated digital time value in said digital time value storage means; and drying state judging means for outputting a drying completion signal based on the digital time value stored in said digital time value storage means.

7. A drying machine according to claim 3, wherein said degree-of-dryness detection means comprises:

instantaneous value detection means for detecting an instantaneous resistance of said detection electrode;

means for converting the detected instantaneous value into a digital time value having a duration corresponding thereto;

digital time value storage means for storing the digital time value;

calculation means for decrementing the digital time value from said digital time value storage means and updating the digital time value each time a predetermined condition is established so as to store the updated digital time value in said digital time value storage means; and drying state judging means for outputting a drying completion signal based on the digital time value stored in said digital time value storage means.

8. A drying machine according to claim 1, wherein said volume-of-clothes detection means detects a volume of clothes based on the number of contact times of the clothes to said detection electrode.

9. A drying machine according to claim 2, wherein said volume-of-clothes detection means detects a volume of clothes based on a time of contact times of the clothes to said detection electrode.

10. A drying machine comprising:

at least two detection electrodes provided in a drum constituting a drying chamber, said electrodes capable of contacting clothes in said drum;

resistance detection means for detecting a resistance of clothes across said detection electrodes based on a degree of contact of the clothes to said detection electrodes upon rotation of said drum;

volume-of-clothes detection means for detecting a volume of clothes based on a degree of contact of the clothes to said detection electrodes upon rotation of said drum;

means for calculating an estimated time based on the resistance detected by said resistance detection means and the volume of clothes detected by said volume-of-clothes detection means; and estimated time display means for displaying the estimated time calculated by said means for calculating the estimated time.

11. The drying machine according to claim 10, further comprising:

degree-of-dryness setting means, operable by a user, for selectively setting a plurality of target degrees of dryness;

remaining operation time determination means for determining a remaining operation time based on the target degree of dryness set by said degree-of-dryness setting means and the resistance of clothes detected by said resistance detection means; and remaining operation time displaying means for displaying the remaining operation time determined by said remaining operation time determination means.

12. A drying machine according to claim 10, further comprising:

degree-of-dryness setting means, operable by a user, for selectively setting a plurality of target degrees of dryness;

remaining operation time determination means for determining a remaining operation time based on the volume of clothes detected by said volume of clothes detection means, the target degree of dryness set by said degree-of-dryness setting means and the resistance of clothes detected by said resistance detection means; and remaining operation time displaying means for displaying the remaining operation time determined by said remaining operation time determination means.

13. A dryness machine according to claim 11, further comprising subtraction means for sequentially decrementing the remaining operation time determined by said remaining operation time determination means, the subtraction result of said subtraction means being displayed on said remaining operation time displaying means.

14. A drying machine according to claim 12, further comprising subtraction means for sequentially decrementing the remaining operation time determined by said remaining operation time determination means, the subtraction result of said subtraction means being displayed on said remaining operation time displaying means.

15. A drying machine according to claim 11, wherein said resistance detection means comprises:

instantaneous value detection means for detecting an instantaneous resistance of said detection electrode;

means for converting the detected instantaneous value into a digital time value having a duration corresponding thereto;

digital time value storage means for storing the digital time value;

calculation means, for decrementing the digital time value from said digital time value storage means and updating the digital time value each time a predetermined condition is established, so as to store the updated digital time value in said digital time value storage means; and drying state judging means for outputting a drying completion signal based on the digital time value stored in said digital time value storage means.

16. A drying machine according to claim 12, wherein said resistance detection means comprises:

instantaneous value detection means for detecting an instantaneous resistance of said detection electrode;

means for converting the detected instantaneous value into a digital time value having a duration corresponding thereto;

digital time value storage means for storing the digital time value;

calculation means, for decrementing the digital time value from said digital time value storage means and updating the digital time value each time a predetermined condition is established, so as to store the updated digital time value in said digital time value storage means; and drying state judging means for outputting a drying completion signal based on the digital time value stored in said digital time value storage means.

17. A drying machine according to claim 10, wherein said volume-of-clothes detection means detects a volume of clothes based on the number of contact times of the clothes to said detection electrode.

18. A drying machine according to claim 11, wherein said volume-of-clothes detection means detects a volume of clothes based on a time of contact of the clothes to said detection electrode.

* * * * *